US006486610B2

(12) United States Patent
Kojima et al.

(10) Patent No.: US 6,486,610 B2
(45) Date of Patent: Nov. 26, 2002

(54) ELECTRON-BEAM GENERATION DEVICE AND IMAGE FORMING APPARATUS

(75) Inventors: Shinsuke Kojima, Kanagawa (JP); Tomoya Onishi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/942,568

(22) Filed: Aug. 31, 2001

(65) Prior Publication Data

US 2002/0047574 A1 Apr. 25, 2002

(30) Foreign Application Priority Data

Sep. 4, 2000 (JP) ..... 2000-267594
Aug. 21, 2001 (JP) ..... 2001-250571

(51) Int. Cl.[7] ..... G09G 3/10

(52) U.S. Cl. ..... 315/169.3; 315/169.1; 313/495; 313/496; 313/497

(58) Field of Search ..... 315/169.1, 169.3, 315/169.4; 313/495–497, 309, 310, 336, 351; 445/24, 31, 50

(56) References Cited

U.S. PATENT DOCUMENTS

| | | | | |
|---|---|---|---|---|
| 4,769,575 A | | 9/1988 | Murata et al. | 313/495 |
| 4,904,895 A | | 2/1990 | Tsukamoto et al. | 313/336 |
| 5,066,883 A | | 11/1991 | Yoshioka et al. | 313/309 |
| 5,528,099 A | * | 6/1996 | Xie et al. | 313/309 |
| 5,569,974 A | | 10/1996 | Morikawa et al. | 313/310 |
| 5,682,085 A | | 10/1997 | Suzuki et al. | 315/169.1 |
| 5,770,918 A | * | 6/1998 | Kawate et al. | 252/514 |
| 5,905,335 A | * | 5/1999 | Fushimi et al. | 313/495 |
| 6,124,671 A | * | 9/2000 | Fushimi et al. | 313/250 |
| 6,267,636 B1 | | 7/2001 | Onishi et al. | 445/6 |
| 6,278,233 B1 | * | 8/2001 | Sanou et al. | 313/292 |

FOREIGN PATENT DOCUMENTS

| | | |
|---|---|---|
| JP | 57-118355 | 7/1982 |
| JP | 61-124031 | 6/1986 |
| JP | 64-31332 | 2/1989 |
| JP | 2-257551 | 10/1990 |
| JP | 3-55738 | 3/1991 |
| JP | 4-28137 | 1/1992 |
| JP | 5-6748 | 1/1993 |

OTHER PUBLICATIONS

C.A. Mead, *Operation of Tunnel–Emission Devices*, Journal of Applied Physics, vol. 32, No. 4 (1961) pp. 646–652.
W.P. Dyke et al., *Field Emission*, Advances in Electronics and Electron Physics (1956), pp. 89–185.

(List continued on next page.)

*Primary Examiner*—Haissa Philogene
(74) *Attorney, Agent, or Firm*—Fitzpatrick, Cella, Harper & Scinto

(57) ABSTRACT

In an electron-beam generation device and an image forming apparatus which can suppress undesirable discharge, there are provided an electron-source substrate having electron emitting devices, and a facing substrate disposed so as to face the electron-source substrate. An anode-potential regulating region which a potential to accelerate electrons emitted from the electron emitting devices is applied on, a conductive member, disposed around the anode-potential regulating region with a predetermined interval therewith, which a predetermined potential is applied on, a resistive film contacting the anode-potential regulating region and the conductive member, and a projection, positioned between the anode-potential regulating region and the conductive member, which is convex with respect to the electron-source substrate are provided on the facing substrate.

47 Claims, 17 Drawing Sheets

OTHER PUBLICATIONS

G. Ditmer, *Electrical Conduction and Electron Emission of Discontinuous Thin Films*, Thin Solid Films, 9 (1972) pp. 317–328.

M.I. Elinson et al., *The Emission of Hot Electrons and the field Emission of Electrons From Tin Oxide*, Radio Engineering and Electronic Physics (1965) pp. 1290–1296.

M. Hartwell et al., *Strong Electron Emission From Patterned Tin–Indium Oxide Thin Films*, International Electron Devices Meeting (1975) pp. 519–521.

H. Araki et al., *Electroforming and Electron Emission of Carbon Thin Films*, (1981) pp. 22–29 (English Abstract on p. 22).

R. Meyer et al., *Recent Development On "Microtips" Display At Leti*, Technical Digest of IVMC (1991) pp. 6–9.

C.A. Spindt et al., *Physical Properties of Thin–Film Field Emission Cathodes with Molybdenum Cones*, Journal of Applied Physics, vol. 47, No. 12, pp. 5248–5263 (1976).

* cited by examiner

ELECTRON-BEAM GENERATION DEVICE AND IMAGE FORMING APPARATUS

BACKGROUND OF THE INVENTION

1. Field of the Invention

The present invention relates to an electron-beam generation device, and an image forming apparatus utilizing the electron-beam generation device.

2. Description of the Related Art

Two types of electron emitting devices, i.e., thermionic-cathode devices and cold-cathode devices, have been known. For example, surface-conduction-type emitting devices, field-emission-type (hereinafter abbreviated as "FE-type") devices, and metal/insulator-metal-type (hereinafter abbreviated as "MIM-type") emitting devices have been known as the cold-cathode-type devices.

For example, a device described in "M. I. Elinson, Radio Eng. Electron Phys., 10, 1290 (1965)" or other devices to be described below have been known as the surface-conduction-type emitting devices.

The surface-conduction-type emitting devices utilize the phenomenon that electron emission occurs by causing a current to flow in a direction parallel to the surface of a small-area thin film formed on a substrate. In addition to the device described by M. I. Elinson which utilizes a $SnO_2$ thin film, a device utilizing an Au thin film (G. Dittmer: "Thin Solid Films", 9, 317 (1972)), a device utilizing an $In_2O_3$/$SnO_2$ thin film (M. Hartwell and C. G. Fonstad: "IEEE Trans. ED Conf.", 519 (1975)), and a device utilizing a carbon thin film (H. Araki et al.: Shinku (J. Vac. Soc. Japan), vol. 26, no. 1, 22 (1983)) have been reported as the surface-conduction-type emitting devices.

FIG. 18 is a plan view of the above-described device by M. Hartwell et al., serving as a typical example of the configuration of a surface-conduction-type emitting device.

In FIG. 18, reference numeral 3001 represents a substrate. A conductive thin film 3004 is made of a metal oxide formed by sputtering.

As shown in FIG. 18, the conductive thin film 3004 is provided in the form of an H-shaped plane. By performing current-supply processing, called current-supply forming, on the conductive thin film 3004, an electron emitting portion 3005 is formed. In FIG. 18, a distance L is set to 0.5–1 mm, and a width W is set to 0.1 mm.

In order to facilitate understanding, the electron emitting portion 3005 is shown in the shape of a rectangle at the center of the conductive thin film 3004. However, this is a schematic diagram, which does not faithfully represent the position and the shape of the actual electron emitting portion.

In the above-described surface-conduction-type emitting devices inclusive of the device by M. Hartwell et al., the electron emitting portion 3005 is generally formed by performing current-supply processing called current-supply forming on the conductive thin film 3004 before performing electron emission.

That is, in the current-supply forming, current is supplied by applying a constant DC voltage or a DC voltage that increases at a very slow rate, such as about 1V/min, between both ends of the conductive thin film 3004, to locally destruct, deform or alter the conductive thin film 3004 in order to form the electron emitting portion 3005 that has a high electric resistance.

Cracks are generated at locally destructed, deformed or altered portions of the conductive thin film 3004.

When an appropriate voltage is applied to the conductive thin film 3004 after the current-supply forming, electron emission occurs at portions near the cracks.

For example, a device described in "W. P. Dyke & W. W. Dolan, "Field emission", Advance in Electron Physics, 8, 89 (1956)", and a device described in "C. A. Spindt, "Physical properties of thin-film field emission cathodes with molybdenum cones", J. Appl. Phys., 47, 5248 (1976)" have been known as the FE-type devices.

FIG. 19 is a cross-sectional view of the above-described device by C. A. Spindt et al., serving as a typical example of the configuration of a FE-type device.

In FIG. 19, there are shown a substrate 3010, an emitter wire 3011 made of a conductive material, an emitter cone 3012, an insulating layer 3013, and a gate electrode 3104.

In this device, by applying an appropriate voltage between the emitter cone 3012 and the gate electrode 3014, field emission occurs from the distal end of the emitter cone 3012.

In another FE-type device, an emitter and a gate electrode are disposed on a substrate so as to be substantially parallel to the plane of the substrate, in contrast to the laminated structure shown in FIG. 19.

For example, a device described in "C. A. Mead, "Operation of tunnel-emission devices", J. Appl. Phys., 32, 646 (1961)", and the like have been known as the MIM-type devices.

FIG. 20 is a cross-sectional view illustrating a typical example of the configuration of an MIM-type device. In FIG. 20, there are shown a substrate 3020, a lower electrode 3021 made of a metal, a thin insulating film having a thickness of about 100 angstroms, and an upper electrode 3023 made of a metal having a thickness of about 80–300 angstroms. In this MIM-type device, by applying an appropriate voltage between the upper electrode 3023 and the lower electrode 3021, electron emission occurs from the surface of the upper electrode 3023.

In the above-described cold-cathode devices, since electron emission can be obtained at a lower temperature than in the thermionic-cathode devices, heaters are unnecessary.

Accordingly, the cold-cathode devices have simpler structures than the thermionic-cathode devices, and therefore small devices can be formed. In addition, even if a large number of devices are disposed on a substrate at high density, problems, such as thermal melt of a substrate, and the like, will hardly arise. Furthermore, in contrast to a slow response speed of the thermionic-cathode devices operating by being heated, a high response speed is obtained for the cold-cathode devices.

Accordingly, applications of the cold-cathode devices are widely being studied. For example, the surface-conduction-type emitting devices are advantageous when forming a large number of devices on a large area, since they have simpler structures and can be more easily manufactured than other types of surface-conduction-type emitting devices.

Hence, as disclosed, for example, in Japanese Patent Application Laid-Open (Kokai) No. 64-31332 (1989) by the assignee of the present application, methods for arranging and driving a large number of devices have been studied.

As for applications of the surface-conduction-type emitting devices, for example, image forming apparatuses, image recording apparatuses and charged beam sources are being studied.

Particularly, as for applications to image forming apparatuses, as disclosed, for example, in U.S. Pat. No.

5,066,883, and Japanese Patent Application Laid-Open (Kokai) Nos. 2-257551 (1990) and 4-28137 (1992) by the assignee of the present application, image forming apparatuses in which surface-conduction-type emitting devices and phosphors emitting light by collision with electrons are combined have been studied.

Image forming apparatuses combining surface-conduction-type emitting devices and phosphors are expected to have better properties than other conventional image forming apparatuses.

For example, these image forming apparatuses are superior to liquid-crystal displays which have recently been widely spread in that a backlight is not required and the angle of visibility is wide because these apparatuses emit light by themselves.

Methods for arranging and driving a large number of FE-type devices are disclosed, for example, in U.S. Pat. No. 4,904,895 by the assignee of the present application, and the like.

As an example of application of FE-type devices to an image forming apparatus, a flat display device reported by R. Mayer et al. (R. Meyer: "Recent Development on Microtips Display at LETI", Tech. Digest of 4th Int. Vacuum Microelectronics Conf., Nagahama, pp. 6–9 (1991)) has been known.

An example of application of a large number of MIM-type devices to an image forming apparatus is disclosed, for example, in Japanese Patent Application Laid-Open (Kokai) No. 3-55738 (1991) by the assignee of the present application.

From among image forming apparatuses using the above-described electron emitting devices, thin flat-surface-type display devices are expected to replace CRT (cathode-ray tube)-type display devices because of their smaller space and lighter weight.

Flat-surface-type display panel units in which an electron-source substrate having such electron emitting devices arranged in the form of a matrix formed thereon is accommodated within an airtight container have been proposed. The inside of the airtight container is maintained at a vacuum equal to or less than about $10^{-4}$ Pa.

Japanese Patent Application Laid-Open (Kokai) No. 5-6748 (1993) discloses a configuration in which in order to reduce the weight of a flat-surface-type CRT, a portion of an accommodating container is made of metal and the metal portion is provided with a ground potential. Also disclosed are a configuration in which a creeping distance is increased by forming protrusions and recesses on the inner surface of screen glass in order to prevent creeping discharge, and a configuration in which a film for preventing secondary electron emission is formed.

FIG. 21 is a schematic diagram in which a display panel is seen from a horizontal direction of an image display surface.

As described above, since the inside of this airtight container must be maintained at a vacuum equal to or less than about $10^{-4}$ Pa, it is necessary to provide means for maintaining a degree of vacuum.

Hence, conventionally, as shown in FIG. 21, a Ba-evaporation-type getter member 70 is disposed outside of an image region together with a getter supporting member 71. The degree of vacuum is maintained by evaporating Ba according to high-frequency heating or the like after sealing the vacuum container, to form a getter film.

In FIG. 21, there are shown a rear plate 1 also operating as an electron-source substrate, an electron-source region 2, a supporting frame 10, a faceplate 20, and an image forming member 3 consisting of a phosphor film and a metal film (for example Al) called a metal back.

In order to accelerate electrons emitted from an electron source, a high voltage (Va) of about several hundreds to several thousands of volts is applied between the electron-source region 2 and the image forming member 3.

The luminance of the image forming apparatus greatly depends on the voltage Va. Accordingly, in order to further increase the luminance, it is necessary to increase the voltage Va.

In accordance with a larger voltage Va, the electric field around the getter member 70 and the getter supporting member 71 outside of the image region also increases. As a result, discharge at portions whose shapes tend to cause concentration of the electric field, such as edge portions of the getter member 70 and the getter supporting member 71, and the boundary between the getter supporting member 71 and the rear plate 1, causes a problem.

In another approach, in order to maintain the atmospheric pressure, as shown in FIG. 22, a structural supporting member (spacer) 13 consisting of a relatively thin glass plate is provided between a rear plate 1 and a faceplate 20 together with a spacer fixing member 14 disposed outside of an image region. FIG. 22 is a schematic diagram illustrating a spacer supporting portion of a conventional electron-beam generation device.

Since the surface of the spacer 13 is exposed to a high electric field, creeping discharge at this surface is a conventional problem.

In order to solve this problem, there have been proposals of removing charges by causing a small current to flow along the surface of the spacer (Japanese Patent Application Laid-Open (Kokai) Nos. 57-118355 (1982) and 61-124031 (1986)). In these proposals, a small current is caused to flow along the surface of the spacer by forming a high-resistance thin film on the surface of the insulating spacer, to reduce charges on the surface and increase the breakdown voltage on the surface.

However, the studies made by the inventors of the present invention have cleared that even if the above-described antistatic film is also provided on the spacer fixing member, discharge at the spacer fixing member cannot be completely prevented depending on conditions of application of a high voltage.

It is considered that this is due to disturbance in the distribution of the potential caused by complexity of the shape of the spacer fixing member, the shape effect (edges and projections), and concentration of the electric field at, for example, a connection portion between the spacer and the spacer fixing member.

Accordingly, as shown in FIG. 23, when there is a structure outside of an image region, discharge at the structure is prevented by adopting a configuration in which a low-resistance conductive member 80 is formed on the inner surface of the faceplate 20 so that a portion of the low-resistance conductive member 80 is closer to the image region than the structure, and is maintained at a ground potential. FIG. 23 is a schematic diagram illustrating a getter portion of a conventional electron-beam generation device.

However, when reducing the distance between the conductive member maintained at a cathode potential and the image region in order to reduce the size of the image forming apparatus, creeping discharge between the conductive member and the image region sometimes causes a problem.

Even at a portion outside of the image region where a structure, such as the getter supporting member or the spacer supporting member described above, is not present, when reducing the distance between the supporting frame 10 and the image region, creeping discharge at the inner surface of the supporting frame 10 sometimes causes a problem.

The above-described discharge abruptly occurs during image display to disturb the displayed image and greatly degrade the electron source near the discharging portion, resulting in incapability of normally displaying the subsequent image.

SUMMARY OF THE INVENTION

It is an object of the present invention to provide an electron-beam generation device and an image forming apparatus for obtaining an excellent displayed image by suppressing undesirable discharge.

According to one aspect, the present invention which achieves the above-described object relates to an electron-beam generation device including an electron-source substrate having electron emitting devices, and a facing substrate disposed so as to face the electron-source substrate. An anode-potential regulating region which a potential to accelerate electrons emitted from the electron emitting devices is applied on, a conductive member, disposed around the anode-potential regulating region with a predetermined interval therewith, which a predetermined potential is applied on, a resistive film contacting the anode-potential regulating region and the conductive member, and a protrusion, positioned between the anode-potential regulating region and the conductive member, which is convex with respect to the electron-source substrate are provided on the facing substrate.

It is preferable that a height of the protrusion is at least 1 $\mu$m.

It is preferable that the protrusion is disposed so as to surround at least three sides of the anode-potential regulating member.

It is preferable that the electron-source generation device further includes a spacer provided between the electron-source substrate and the facing substrate so as to maintain an interval between the electron-source substrate and the facing substrate. At least part of the spacer and a member for fixing the spacer is present outside of the anode-potential regulating region. The protrusion is formed at a portion other than a portion where the spacer or the member for fixing the spacer is formed.

According to another aspect, the present invention which achieves the above-described object relates to an electron-beam generation device including an electron-source substrate having electron emitting devices, and a facing substrate disposed so as to face the electron-source substrate. An anode-potential regulating region which a potential to accelerate electrons emitted from the electron emitting devices is applied on, a conductive member, disposed around the anode-potential regulating region with a predetermined interval therewith, which a predetermined potential is applied on, a resistive film contacting the anode-potential regulating region and the conductive member, and a recess, positioned between the anode-potential regulating region and the conductive member, which is concave with respect to the electron-source substrate is provided on the facing substrate.

It is preferable that the recess is disposed so as to surround at least three sides of the anode-potential regulating member.

It is preferable that the electron-source generation device further includes a spacer provided between the electron-source substrate and the facing substrate so as to maintain an interval between the electron-source substrate and the facing substrate. At least part of the spacer and a member for fixing the spacer is present outside of the anode-potential regulating region. The recess is formed at a portion other than a portion where the spacer or the member for fixing the spacer is formed.

According to still another aspect, the present invention which achieves the above-described object relates to an electron-beam generation device including an electron-source substrate having electron emitting devices, and a facing substrate disposed so as to face the electron-source substrate. An anode-potential regulating region which a potential to accelerate electrons emitted from the electron emitting devices is applied on, a conductive member, disposed around the anode-potential regulating region with a predetermined interval therewith, which a predetermined potential is applied on, a resistive film contacting the anode-potential regulating region and the conductive member, and protrusions and recesses positioned between the anode-potential regulating region and the conductive member are provided on the facing substrate.

It is preferable that the protrusions and recesses are disposed so as to surround at least three sides of the anode-potential regulating member.

It is preferable that the electron-source generation device further includes a spacer provided between the electron-source substrate and the facing substrate so as to maintain an interval between the electron-source substrate and the facing substrate. At least part of the spacer and a member for fixing the spacer is present outside of the anode-potential regulating region. The protrusions and recesses are formed at a portion other than a portion where the spacer or the member for fixing the spacer is formed.

According to yet another aspect, the present invention which achieves the above-described object relates to an electron-beam generation device including an electron-source substrate having electron emitting devices, and a facing substrate disposed so as to face the electron-source substrate. An anode-potential regulating region which a potential to accelerate electrons emitted from the electron emitting devices is applied on, and a conductive member, disposed around the anode-potential regulating region with a predetermined interval therewith, which a predetermined potential is applied on are provided on a same surface of the facing substrate facing the electron-source substrate. A multiple-scattering suppression structure for suppressing multiple scattering of secondary electrons generated by electrons emitted from the conductive member is disposed between the anode-potential regulating region and the conductive member on the same surface.

In the above-described inventions, it is preferable that the conductive member is disposed so as to completely surround the anode-potential regulating region.

In the above-described inventions, it is preferable that the resistive film causes a small current to flow between the anode-potential regulating region and the conductive member, and that a sheet resistance of the resistive film is within a range equal to or more than $1\times10^7$ Ω/□ and equal to or less than $1\times10^{14}$ Ω/□.

In the above-described inventions, it is preferable that each of the electron emitting devices is a cold-cathode device, that each of the electron emitting devices has a conductive film including an electron emitting portion between electrodes, and that each of the electron emitting devices is a surface-conduction-type electron emitting device.

In the above-described inventions, it is preferable that a voltage applied between the anode-potential regulating region and electrodes on a surface of the electron-source substrate having the electron emitting devices is at least 3 kV.

In the above-described inventions, it is preferable that a potential lower than the anode potential is applied on the conductive member. It is also preferable that a cathode potential is applied on the conductive member.

In the above-described inventions, it is preferable that a ground potential is applied on the conductive member.

This application also includes inventions of image forming apparatuses at each of which phosphors emitting light by electrons emitted from the electron emitting devices are added to each of the electron-beam generation devices of the above-described inventions.

The foregoing and other objects, advantages and features of the present invention will become more apparent from the following description of the preferred embodiments taken in conjunction with the accompanying drawings.

DETAILED DESCRIPTION OF THE PREFERRED EMBODIMENTS

Figure 1:
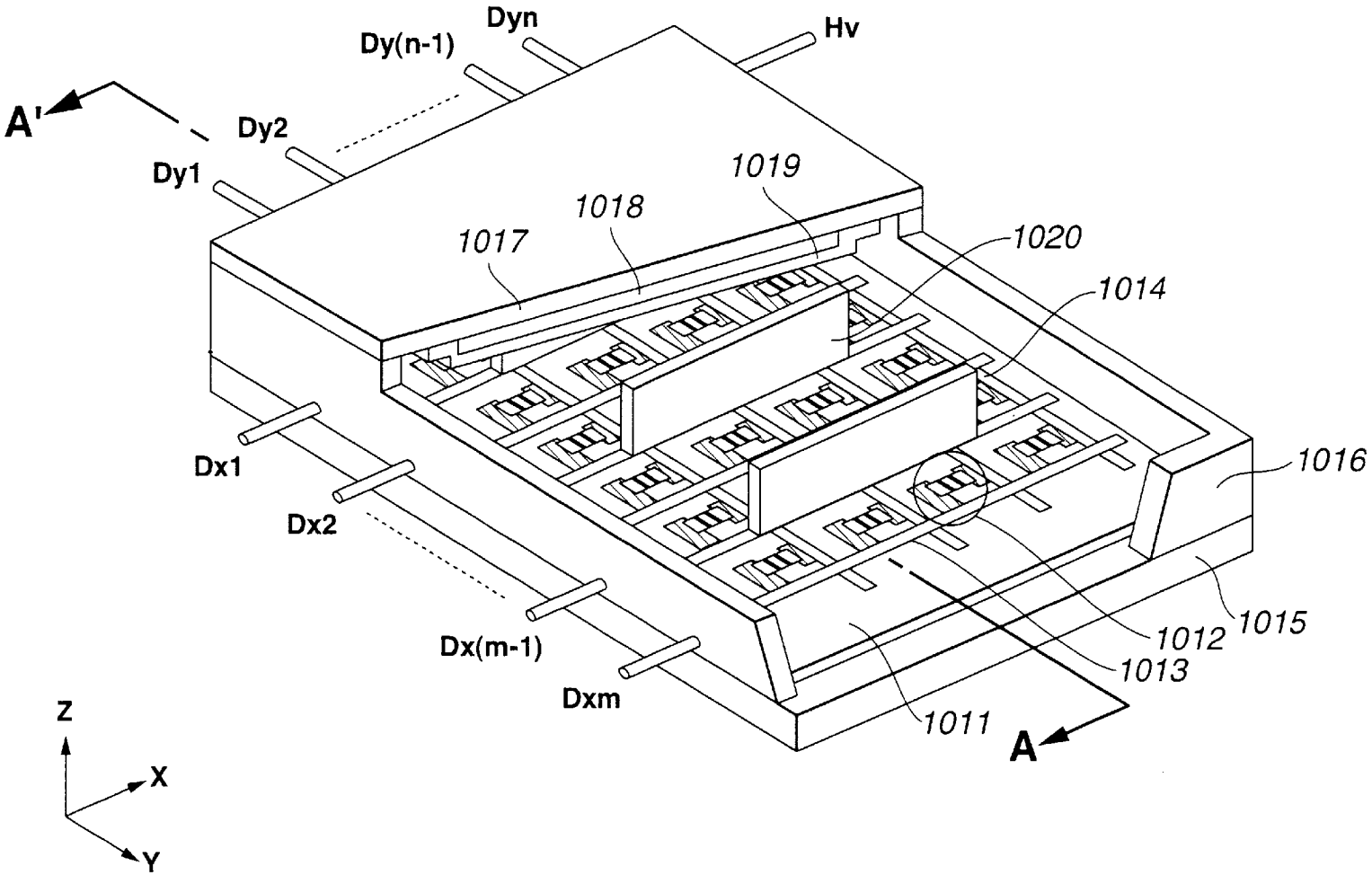
FIG. 1 is a partially broken perspective view illustrating an electron-beam generation device according to an embodiment of the present invention.

A preferred embodiment of the present invention will now be described in detail with reference to the drawings. The scope of the present invention is not limited to the dimensions, the materials, the shapes, the relative arrangements and the like of components described in the embodiment, unless particularly mentioned.

In the following drawings, the same components as those shown in the drawings used in the description of the prior art are indicated by the same reference numerals.

(Electron-beam Generation Device)

The configuration and the manufacturing method of a display panel of an image forming apparatus to which an electron-beam generation device according to the present invention is applied will now be specifically described.

First, the configuration of the entire panel will be described, followed by a detailed description of characteristic portions of the present invention.

FIG. 1 is a perspective view of a display panel according to the embodiment. In order to show the internal configuration, a portion of the panel is cut away. FIG. 1 is a partially broken perspective view illustrating an electron-beam generation device according to the embodiment.

In FIG. 1, there are shown a rear plate 1015, a side wall 1016, and a faceplate 1017. These components constitute an airtight container for maintaining the inside of the display panel at a vacuum. In FIG. 1, a conductive member surrounding an anode-potential regulating region, a convex structure for suppressing multiple scattering, and the like are omitted.

Each of the rear plate 1015, serving as an electron-source substrate, and the faceplate 1017, serving as a facing plate, is an insulating substrate made of each type of material, such as soda-lime glass, soda-lime glass having a $SiO_2$ film formed on a surface thereof, glass having a less amount of Na, quartz glass, ceramics or the like, depending on conditions.

When assembling an airtight container, it is necessary to seal the above-described components in order to maintain sufficient strength and air tightness at contact portions between the components. The sealing is achieved by coating frit glass at contact portions and firing the coated glass at 400–500° C. for at least ten minutes in the air or nitrogen atmosphere. The method for evacuating the inside of the airtight container will be described later.

The inside of the airtight container is maintained at a vacuum equal to or less than $10^{-4}$ Pa. Hence, in order to prevent destruction of the airtight container due to the atmospheric pressure, sudden shock or the like, spacers 1020 are provided as atmospheric-pressure resisting structures.

Next, a description will be provided of an electron-source substrate which can be used in the image forming apparatus of the invention.

The electron-source substrate used in the image forming apparatus of the invention is formed by arranging a plurality of cold-cathode devices on a substrate.

Methods for arranging cold-cathode devices include ladder-type arrangement in which cold-cathode devices are arranged in parallel and both ends of respective devices are connected by wires (hereinafter termed a "ladder-type-arrangement electron-source substrate"), and simple matrix arrangement in which x-direction wires and y-direction wires of a pair of electrodes of each of cold-cathode devices are connected, respectively, (hereinafter termed a "matrix-arrangement electron-source substrate").

In an image forming apparatus having a ladder-type electron-source substrate, it is necessary to provide a control electrode (grid electrode) for controlling movement of electrons from each of electron emitting devices.

A substrate 1011 is fixed on the rear plate 101. N×M (N and M are positive integers equal to or larger than 2, which are appropriately set in accordance with the number of pixels to be displayed) cold-cathode electrodes are formed on the substrate 1011.

For example, in a display device for a high-quality television, it is desirable to set N and M to values of at least 3,000 and 1,000, respectively.

The N×M cold-cathode devices are subjected to simple matrix wiring by M row-direction wires 1013 and N column-direction wires. A portion configured by the above-described components 1011–1014 is called a multi-electron-beam source.

There are no limitations for the material, the shape and the manufacturing method of the cold-cathode devices of the multi-electron-beam source used in the image forming apparatus of the invention, provided that the cold-cathode devices are subjected to simple matrix wiring or ladder-type wiring.

Accordingly, for example, surface-conduction-type emitting devices, or cold-cathode devices, such as FE-type devices, MIM-type devices or the like, may be used.

Next, a description will be provided of the structure of a multi-electron-beam source in which surface-conduction-type emitting devices (to be described later), serving as cold-cathode devices, are arranged and subjected to simple matrix wiring on the substrate.

Figure 2:
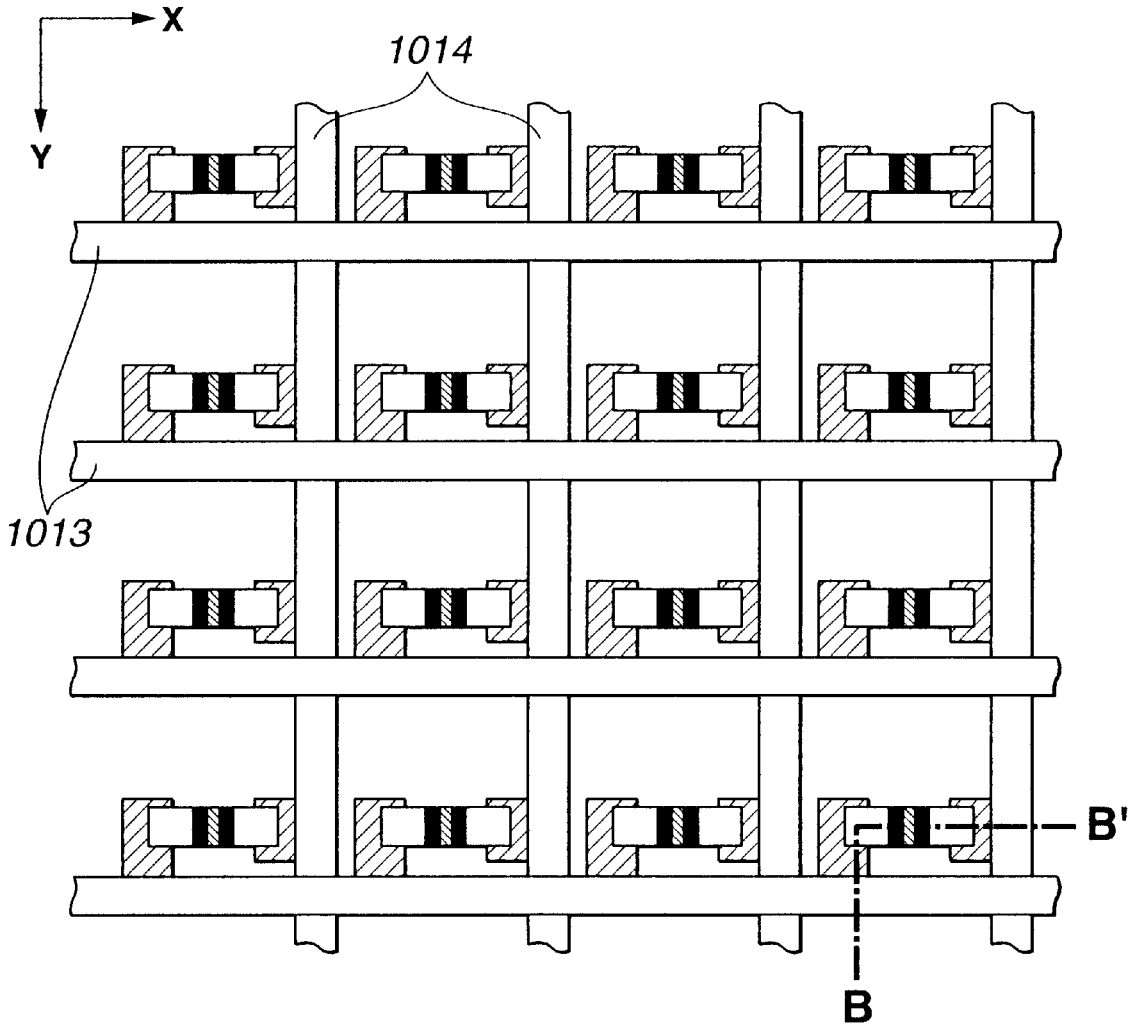
FIG. 2 is a plan view illustrating a multi-electron-beam source used in a display panel shown in FIG. 1.

FIG. 2 is a plan view of a multi-electron-beam source used in the display panel shown in FIG. 1.

Surface-conduction-type emitting devices each of which is the same as that shown in FIGS. 6A and 6B (to be described later) are arranged on the substrate 1011, and are subjected to simple matrix wiring by the row-direction wires 1013 and the column-direction wires 1014.

An insulating layer (not shown) is formed between electrodes at each of portions where the row-direction wires 1013 and the column-direction wires 1014 cross, in order to provide electric insulation.

Figure 3:
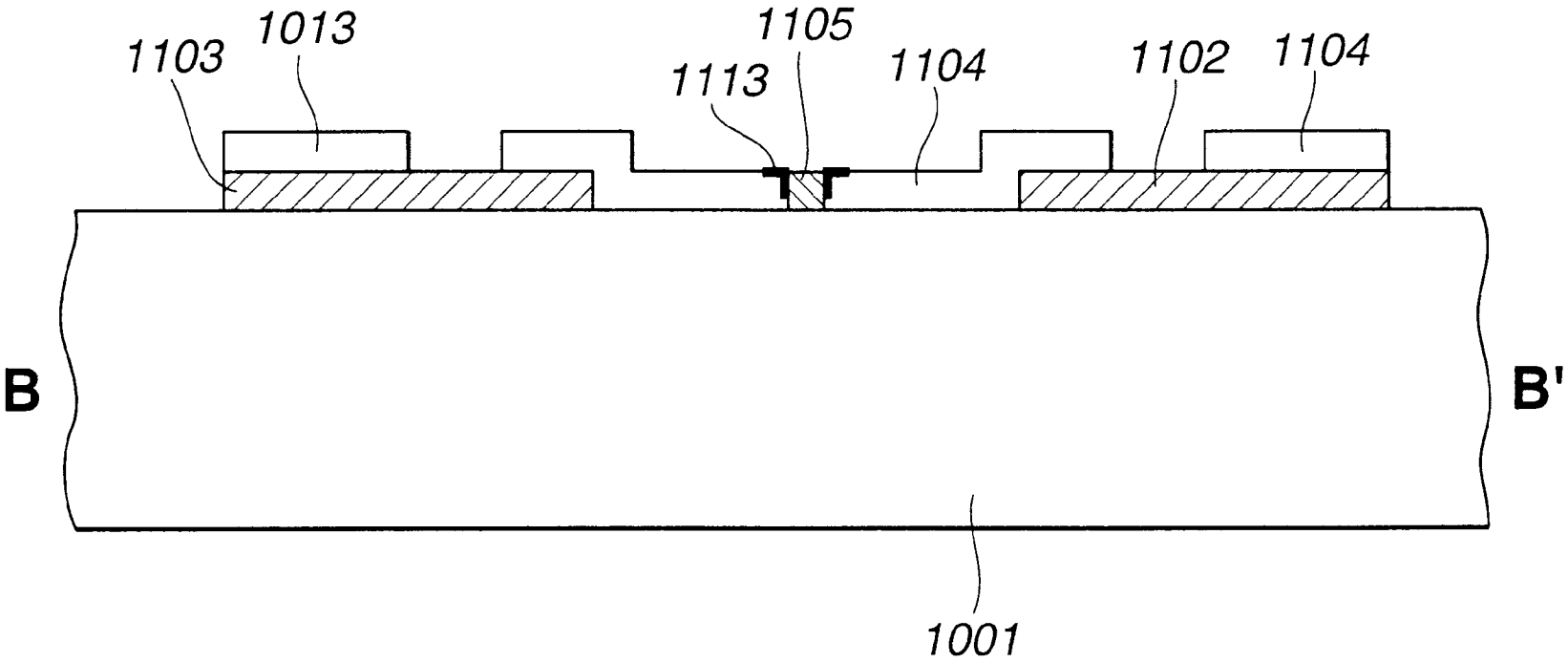
FIG. 3 is a cross-sectional view taken along line B–B' shown in FIG. 2.

FIG. 3 is a cross section taken along line B–B' shown in FIG. 2. The multi-electron-beam source having this configuration is manufactured by forming in advance the row-direction wires 1013, the column-direction wires 1014, the inter-electrode insulating layers (not shown), and electrodes and conductive thin films of the surface-conduction-type emitting devices, and then performing current-supply forming processing (to be described later) and current-supply activation processing (to be described later) by supplying current for the respective devices via the row-direction wires 1013 and the column-direction wires 1014.

Although in this embodiment, a configuration in which the substrate 1011 for the multi-electron-beam source is fixed on the rear plate 1015 of the airtight container is adopted, the substrate 1011 for the multi-electron-beam source may be used as the rear plate of the airtight container if the substrate 1011 for the multi-electron-beam source has a sufficient strength.

A phosphor film 1018 is formed on the lower surface of the faceplate 1017. Since a color display device is used in this embodiment, phosphors having three primary colors, i.e., red, green and blue, used in the field of CRTs are coated at corresponding portions of the phosphor film 1018.

Figure 4:
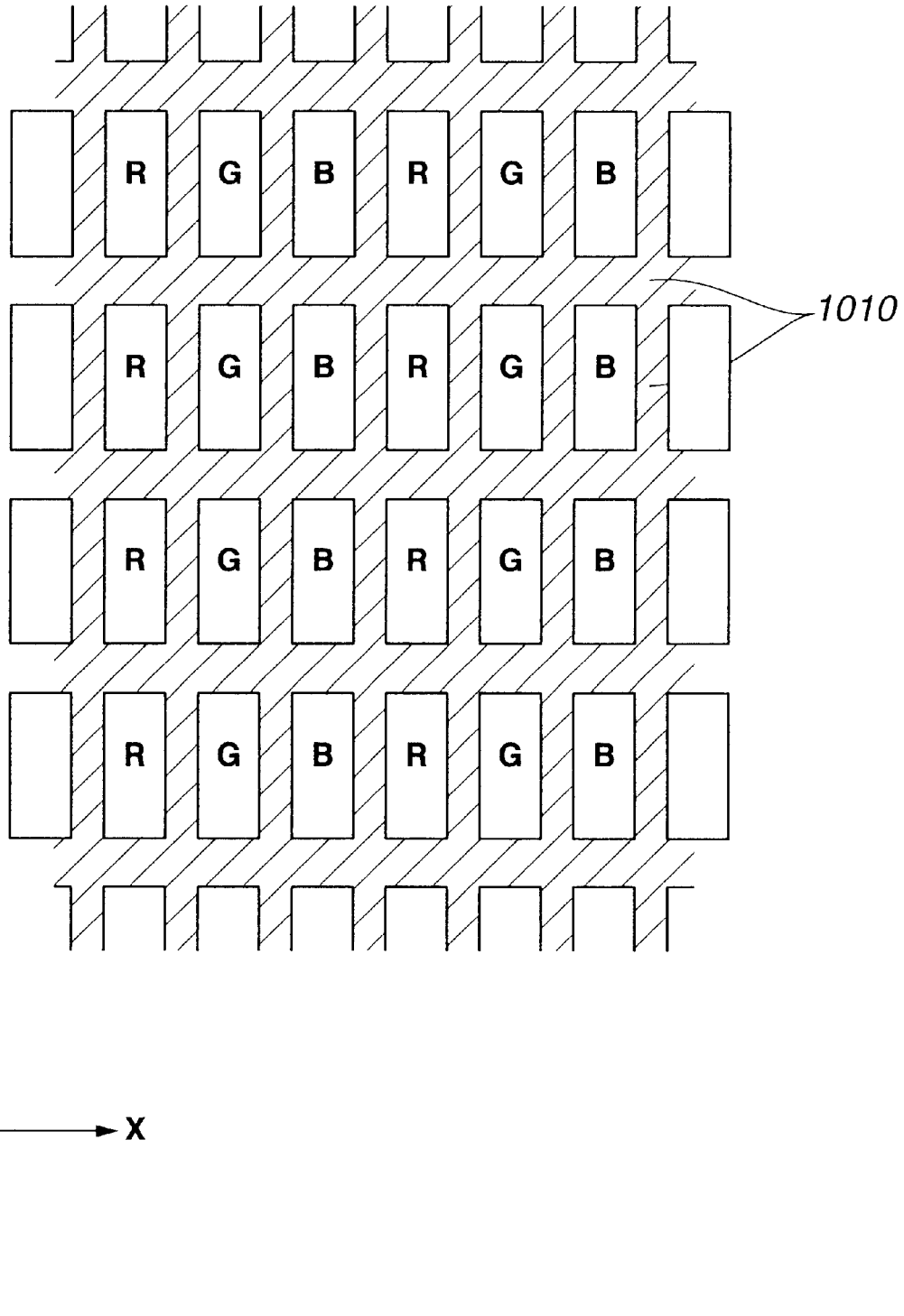
FIG. 4 is a plan view illustrating the arrangement of phosphors on a faceplate of the display panel used in the electron-beam generation device shown in FIG. 1.

As shown in FIG. 4, a black conductor 1010 is provided between phosphors of the respective colors. FIG. 4 is a plan view illustrating the arrangement of phosphors on the faceplate of the display panel used in the electron-beam generation device shown in FIG. 1.

The black conductor 1010 is provided in order to prevent, for example, deviation in a displayed color even if the position of irradiation by an electron beam more or less deviates, a decrease in the display contrast by preventing reflection of external light, and charging of the phosphor film 1018 by electron beams.

Graphite is used as the main component of the black conductor 1010. However, any other appropriate material may also be used provided that the above-described objects are achieved.

A metal back 1019 which is known in the field of CRTs is provided on a surface of the phosphor film 1018 facing the rear plate 1015.

The metal back 1019 is provided, for example, in order to improve the rate of utilization of light by performing mirror reflection of part of light emitted from the phosphor film 1018, protect the phosphor film 1018 from collision of negative ions, operate as an electrode for applying a voltage for accelerating electron beams, and operate as a conduction path for electrons having excited the phosphor film 1018.

The metal back 1019 is formed by performing smoothing processing for the surface of the phosphor film 1018 after forming the phosphor film 1018 on the faceplate 1017, and then depositing Al thereon in a vacuum. An anode potential is supplied to the metal back 1019. A region where the metal back 1019 is formed becomes an anode-potential regulating region.

Figure 5:
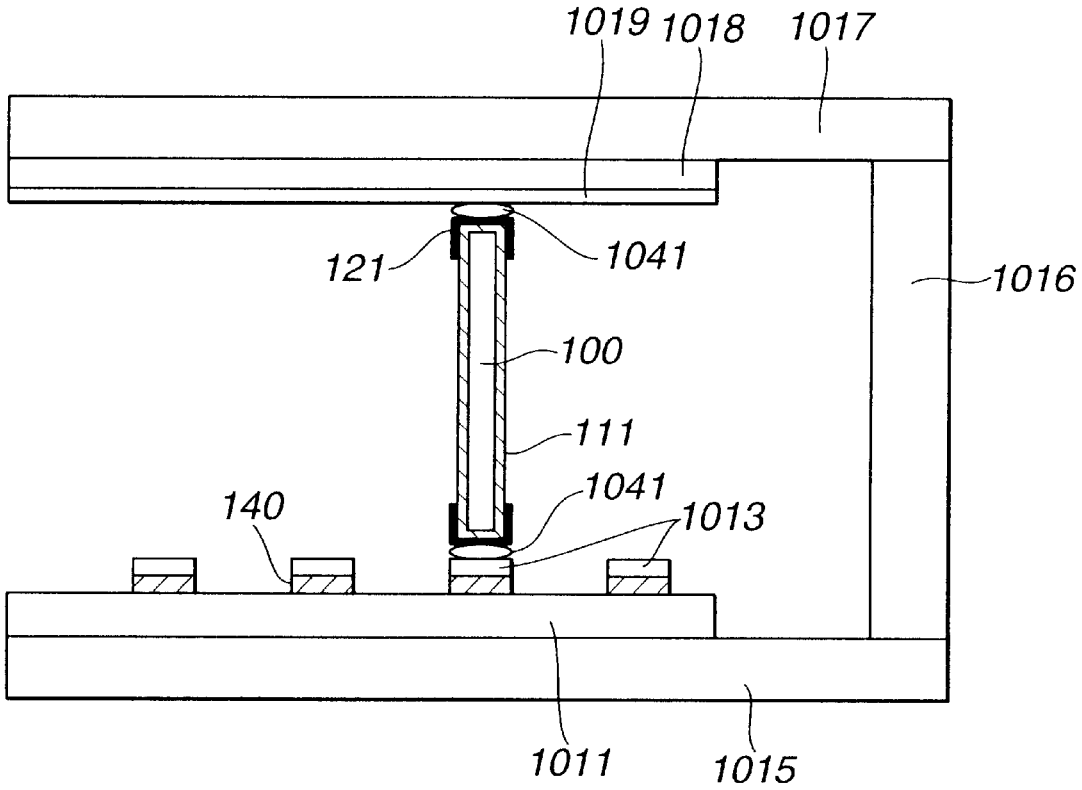
FIG. 5 is a cross-sectional view taken along line A–A' in the electron-beam generation device shown in FIG. 1.

FIG. 5 is a schematic cross-sectional view taken along line A–A' shown in FIG. 1. Reference numerals shown in FIG. 5 correspond to those shown in FIG. 1. In FIG. 5, also, a conductive member, a projection and the like surrounding the anode-potential regulating region are omitted.

The spacer 1020 is obtained by forming an antistatic high-resistance film 111 on the surface of an insulating member 100, and also forming low-resistance films 121 on contact surfaces of the spacer 1020 facing the inner side (the metal back 1019) of the faceplate 1017 and the surface (the row-direction wire 1013 or the column-direction wire 1014) of the substrate 1011 and on sides contacting the contact surfaces of the spacer 1020. The spacers 1020 are provided in a number necessary for achieving the above-described objects at a necessary interval, and are fixed on the inner side of the faceplate 1017 and the surface of the substrate 1011.

The high-resistance film 111 is formed at least on a surface exposed to a vacuum within the airtight container from among the surface of the insulating member 100, and is electrically connected to the inside (the metal back 1019) of the faceplate 1017 and the surface (the row-direction wire 1013 or the column-direction wire 1014) of the substrate 1011 via the low-resistance film 121 on the spacer 1020.

In this embodiment, the spacers 1020 have the shape of a thin plate, are disposed in parallel to the row-direction wires 1013, and are electrically connected to the column-direction wires 1013.

The spacer 1020 must have an insulating property sufficient enough to resist against a high voltage applied between the row-direction wires 1013 and the column-direction wires 1014 on the substrate 1011, and the metal back 1019 on the inner surface of the faceplate 1017, and also must have a conductivity sufficient enough to prevent charging of the surface of the spacer 1020.

For example, quartz glass, glass having a less amount of impurities, such as Na and the like, soda-lime glass, ceramics, such as alumina or the like, may be used for the insulating member 100 of the spacer 1020.

The coefficient of thermal expansion of the insulating member 100 is preferably close to the coefficients of thermal expansion of the materials of the airtight container and the substrate 1011.

A current obtained by dividing an acceleration voltage Va applied to the faceplate 1017 (the metal back 1019) at a high potential side by the resistance Rs of the high-resistance film 111, serving as an antistatic film, is supplied for the high-resistance film 111 constituting the spacer 1020.

Accordingly, the resistance Rs of the spacer 1020 is set within a desirable range in consideration of prevention of charging and power consumption.

From the viewpoint of prevention of charging, the surface resistance of the spacer 1020 is preferably equal to or less than $10^{14}$ Ω/□.

In order to obtain a sufficient effect of prevention of charging, the surface resistance of the spacer 1020 is more preferably equal to or less than $10^{11}$ Ω/□. Although the lower limit of the surface resistance depends on the shape of the spacers 1020 and a voltage applied between the spacers 1020, the surface resistance of the spacer 1020 is preferably equal to or more than $10^{7}$ Ω/□.

The thickness of the antistatic film 111 formed on the insulating member 100 is preferably within a range of 10 nm–8 μm.

Although it depends on the surface energy of the material, adhesiveness to the substrate, and the substrate temperature, in general, a thin film having a thickness equal to or less than 10 nm is formed in the form of islands, and has an unstable resistance and poor reproducibility.

The temperature of the spacer 1020 rises by current supply to the antistatic film 111 formed on the spacer 1020 in the above-described manner or heating of the entire display during operation.

If the temperature coefficient of resistance of the antistatic film 111 has a large negative value, the resistance decreases when the temperature rises, to increase the current flowing through the spacer 1020, and thereby to raise the temperature.

The current continues to increase until it exceeds the limit of the power supply. The temperature coefficient of resistance for causing such runaway of the current empirically has a negative value whose absolute value is equal to or less than 1%/° C.

That is, the temperature coefficient of resistance of the antistatic film 111 has a negative value equal to or more than −1%/° C.

For example, a metal oxide may be used as the material for the antistatic high-resistance film 111.

An oxide of chromium, nickel or copper is preferable from among metal oxides.

This is because such an oxide has a relatively small secondary emission efficiency, so that electrons emitted from the cold-cathode device 1012 are hardly charged even if they impinge upon the spacer 1020.

In addition to metal oxides, carbon is also preferable because it has a small secondary emission efficiency. Particularly, since amorphous carbon has a high resistivity, the resistance of the spacer 1020 made of amorphous carbon can be easily controlled to a desired value.

A nitride of an alloy of aluminum and a transition metal is also preferable as the material for the antistatic high-resistance film 111, because the resistance of the high-resistance film 111 can be controlled within a wide range between the resistance of a conductor and the resistance of an insulator by adjusting the composition of the transition metal.

Furthermore, such a nitride is stable in a process for manufacturing a display device (to be described later) because a change in the resistance is small.

In addition, the temperature coefficient of resistance of such a nitride is larger than −1%/° C., so that the nitride can be practically used easily.

The transition metals include Ti, Cr, Ta, W and the like. A nitride film is formed on the insulating member 100 according to a thin-film forming method, such as sputtering, reactive sputtering in a nitrogen atmosphere, electron-beam vacuum deposition, ion plating, ion assisting vacuum deposition, or the like. A metal oxide may also be formed according to the same thin-film forming method. In this case, however, an oxygen gas is used instead of a nitrogen gas. The metal oxide may also be formed according to CVD (chemical vapor deposition), an alkoxide coating method, or the like.

The carbon film is formed according to vacuum deposition, sputtering, CVD, or plasma CVD. Particularly, when forming an amorphous-carbon film, hydrogen is added to the atmosphere during film formation, or a hydrocarbon gas is used as a film forming gas.

A nitride, an oxide, a carbide or a boride including carbon, silicon or germanium may also be used as the material for the high-resistance film 111.

The low-resistance film 121 constituting the spacer 1020 is provided in order to electrically connect the high-resistance film 111 to the faceplate 1017 (the metal back 101) at a high-potential side and the substrate 1011 (the wires 1013 and 1014) at a low-potential side, and is hereinafter also termed a spacer electrode 121. The spacer electrode 121 can have the following plural functions.

The first function is to electrically connect the high-resistance film 111 to the faceplate 1017 and the substrate 1011.

As already has been described, the high-resistance film 111 is provided in order to prevent charging on the surface of the spacer 1020. When the high-resistance film 111 is connected to the faceplate 1017 (the metal back 1019) and the substrate 1011 (the wire 1013 or 1014) directly or via a contact member 1041, a large contact resistance arises at a contact interface. As a result, there arises the possibility that charges generated on the surface of the spacer 1020 cannot be promptly removed.

In order to solve this problem, the low-resistance spacer electrode 121 is provided on the contact surface of the spacer 1020 contacting the faceplate 1017 or the substrate 1011 via the contact member 1041 and on the side portions of the spacer 1020.

The second function is to uniform the potential distribution on the high-resistance film 111. Electrons emitted from the cold-cathode device 1012 move along an electron orbit according to a potential distribution formed between the faceplate 1017 and the substrate 1011. In order to prevent disturbance in the electron orbit near the spacer 1020, it is necessary to control the potential distribution of the high-resistance film 111 over the entire region.

When connecting the high-resistance film 111 to the faceplate 1017 (the metal back 1019) and the substrate 1011 (the wire 1013 or 1014) directly or via the contact member 1041, unevenness in the contact state occurs due to the contact resistance at the contact interface. As a result, there is the possibility that the potential distribution in the high-resistance film 111 deviates from a desired value.

In order to solve this problem, the low-resistance spacer electrode 121 is provided over the entire length of the end portion (a contact surface 3 or a side portion 5) of the spacer 1020 which contacts the faceplate 1017 or the substrate 1011. By applying a desired voltage to the spacer electrode 121, the potential of the entire high-resistance film 111 can be controlled.

The third function is to control the orbit of emitted electrons. Electrons emitted from the cold-cathode device 1012 move along an electron orbit according to the potential distribution formed between the faceplate 1017 and the substrate 1011.

As for electrons emitted from a cold-cathode device near the spacer 1020, restrictions (changes in the positions of wires and the device, and the like) may arise due to provision of the spacer 1020.

In such cases, in order to form an image free from distortion and unevenness, it is necessary to project electrons onto a desired position on the faceplate 1017 by controlling the orbit of emitted electrons.

By providing the low-resistance spacer electrodes 121 at side portions of the surfaces contacting the faceplate 1017 and the substrate 1011, it is possible to provide the potential distribution near the spacer 1020 with desired characteristics, and control the orbit of emitted electrons.

A material having a sheet resistance sufficiently lower (by at least one digit) than the sheet resistance of the high-resistance film 111 may be selected for the low-resistance film 121. For example, a metal such as Ni, Cr, Au, Mo, W, Pt, Ti, Al, Cu, Pd or the like, an alloy of some of these metals, a printing conductor including a metal or a metal oxide, such as Pd, Ag, Au, $RuO_2$, Pd—Ag or the like, glass and the like, a transparent conductor, such as $In_2O_3$—$SnO_2$ or the like, a semiconductor material, such as polysilicon or the like, may be appropriately selected.

Symbols Dx1–Dxm, Dy1–Dyn, and Hv represent airtight terminals for electric connection provided in order to electrically connecting the display panel to external circuits (not shown).

The terminals Dx1–Dxm, Dy1–Dyn, and Hv are electrically connected to the row-direction wires 1013 of the electron-beam source, the column-direction wires 1014 of the electron-beam source, and the metal back 1019 of the faceplate 1017, respectively.

In order to evacuate the inside of the airtight container, an exhaust tube (not shown) is connected to a vacuum pump after assembling the airtight container, and the inside of the airtight container is evacuated to a degree of vacuum of about $10^{-5}$ Pa.

Then, the exhaust tube is sealed. In order to maintain the degree of vacuum within the airtight container, a getter film (not shown) is formed at a predetermined position within the airtight container immediately before sealing or after sealing.

The getter film is formed, for example, by heating and depositing a getter material having Ba as the main component by a heater or high-frequency heating. According to the adsorption function of the getter film, the inside of the airtight container is maintained at a degree of vacuum within a range equal to or more than $1\times10^{-5}$ Pa and equal to or less than $1\times10^{-7}$ Pa, or more than $1\times0^{-7}$ Pa.

In the image forming apparatus using the above-described display panel, when a voltage is applied to each of the cold-cathode devices 1012 through appropriate ones of the terminals Dx1–Dxm and Dy1–Dyn, electrons are emitted from the concerned cold-cathode device 1012.

At the same time, a high voltage exceeding 3 kV is applied to the metal back 1019 via the terminal Hv. Since the voltage applied to each of the cold-cathode devices 1012 is close to the ground potential, a voltage of at least 3 kV is applied between each electron emitting device and the metal back 1019, to accelerate emitted electrons to cause them to impinge upon the inner surface of the faceplate 1017.

Thus, phosphors having respective colors constituting the phosphor film 1018 are excited to emit light, whereby an image is displayed.

Usually, the voltage applied to the surface-conduction-type emitting device 1012, serving as the cold-cathode device, of the invention is about 12–16 V, the distance d between the metal back 1019 and the cold-cathode device 1012 is about 0.1–8 mm, and the voltage between the metal back 1019 and the cold-cathode device 1012 is about 3–10 kV.

The basic configuration and the manufacturing method of the display panel of the embodiment, and an outline of the image forming apparatus have been described.

Next, a description will be provided of a method for manufacturing the multi-electron-beam source used in the display panel of the embodiment.

In the multi-electron-beam source used in the image forming apparatus of the invention, there is no limitation for the material, the shape and the manufacturing method of cold-cathode devices, provided that the cold-cathode devices are subjected to simple matrix wiring.

Accordingly, cold-cathode devices, such as surface-conduction-type emitting devices, FE-type devices, MIM-type devices or the like may be used.

However, the surface-conduction-type emitting devices are particularly preferable from among these cold-cathode devices when an inexpensive display device having a large display surface is required.

Since the surface-conduction-type emitting devices are formed according to a relatively simple manufacturing method, it is easy to provide a large area and reduce the production cost.

The inventors of the present invention have found that from among surface-conduction-type emitting devices, devices in which electron emitting portions and surrounding portions thereof are formed by a fine-particle film have particularly excellent election emission characteristics and can be easily manufactured.

Accordingly, it can be said that devices of this type are most suitable for being used for a multi-electron-beam source of a high-luminance and large-surface image forming apparatus.

Hence, in the display panel of the embodiment, surface-conduction-type emitting devices in which electron emitting portions an surrounding portions thereof are formed by a fine-particle film are used. First, the basic configuration, the manufacturing method and the characteristics of suitable surface-conduction-type emitting devices will be described. Thereafter, the structure of a multi-electron-beam source in which a large number of devices are subjected to simple matrix wiring will be described.

(Suitable Configuration and Manufacturing Method of Surface-conduction-type Emitting Devices)

Typical configurations of surface-conduction-type emitting devices in which electron emitting portions and surrounding portions thereof are formed by a fine-particle film include two types, i.e., a flat-surface type and a vertical type. A description will be provided of only flat-surface-type devices which have actually been manufactured.

(Flat-surface-type Surface-conduction-type Emitting Devices)

The configuration and the manufacturing method of flat-surface-type surface-conduction-type emitting devices will now be described. FIGS. 6A and 6B are a plan view and a cross-sectional view, respectively, illustrating the configuration of one of flat-surface-type surface-conduction-type emitting devices used in the electron-beam generation device shown in FIG. 1.

Figure 6A:
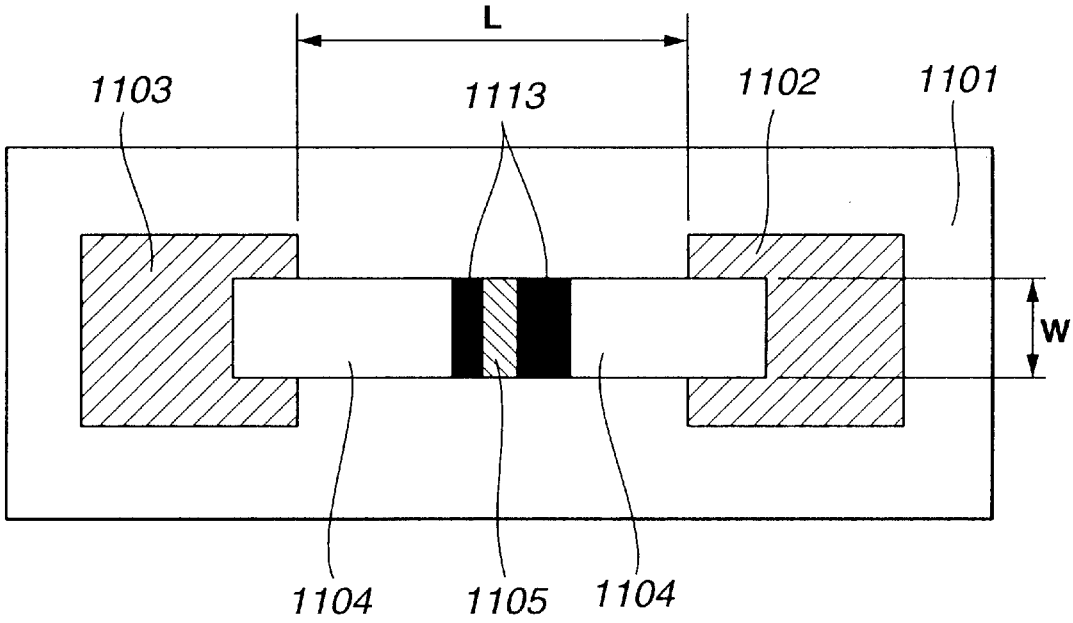
FIGS. 6A and 6B are a plan view and a cross-sectional view, respectively, of a flat surface-conduction-type emitting device used in the electron-beam generation device shown in FIG. 1.
Figure 6B:
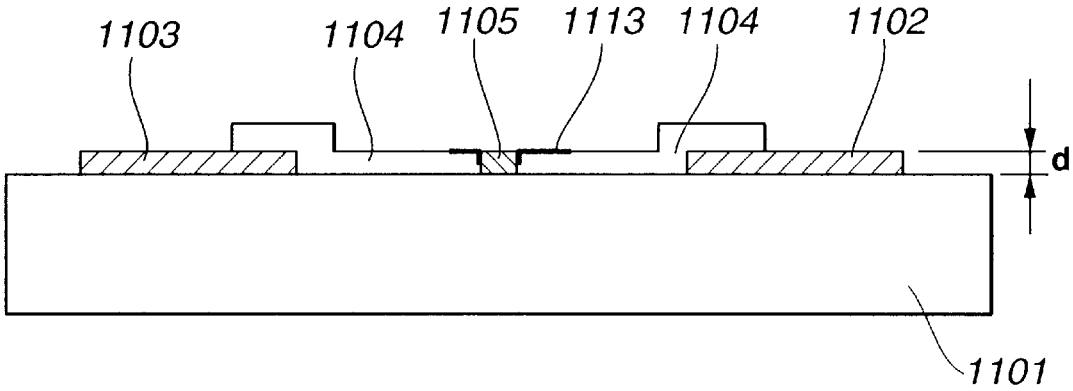

In FIGS. 6A and 6B, there are shown a substrate 1101, device electrodes 1102 and 1103, a conductive thin film 1104, an electron emitting portion 1105 formed by current-supply forming processing, and a thin film 1113 formed by current-supply activation processing.

Each type of glass substrate made of quartz glass, soda-lime glass or the like, each type of ceramic substrate made of alumina or the like, a substrate obtained by laminating an insulating layer, for example, made of $SiO_2$ on each of the above-described substrates, or the like may be used as the substrate 1101.

The device electrodes 1102 and 1103 provided in parallel to the surface of the substrate 1101 so as to face each other are made of a conductive material.

For example, a metal, such as Ni, Cr, Au, Mo, W, Pt, Ti, Cu, Pd, Ag or the like, an alloy of some of these metals, a metal oxide, such as $In_2O_3$—$SnO_2$ or the like, a semiconductor, such as polysilicon or the like, may be appropriately selected as the conductive material.

The electrodes may be easily formed by combining a film forming technique, such as vacuum deposition or the like, and a patterning technique including photolithography, etching and the like. Any other method (for example, a printing technique) may also be used.

The shape of the device electrodes 1102 and 1103 are appropriately designed in accordance with the objects of application of the electron emitting devices.

In general, the electrode interval L is selected within a range between several hundreds of Å and several hundreds of $\mu$m. Particularly, in order to apply the electron emitting devices to a display device, a range between several $\mu$m and several tens of $\mu$m is preferable.

As for the thickness d of the device electrodes 1102 and 1103, an appropriate value is usually selected within a range of several hundreds of Å and several $\mu$m.

A fine-particle film is used as the conductive film 1104. The fine-particle film indicates a film including a large amount of fine particles (inclusive of an island-like aggregate).

When a fine-particle film is microscopically investigated, a structure in which individual fine particles are separately disposed, a structure in which fine particles are adjacent to one another, or a structure in which fine particles are superposed is observed.

The particle diameters of fine particles used in the fine-particle film are within a range of several Å and several thousands of Å, and are preferably within a range of 10 Å and 200 Å.

The thickness of the fine-particle film is appropriately set in consideration of the following conditions. That is, the conditions include a necessary condition for electrically connecting the fine-particle film to the device electrodes 1102 and 1103 excellently, a necessary condition for performing current-supply forming (to be described later) excellently, a necessary condition for setting the electric resistance of the fine-particle film to an appropriate value (to be described later), and the like. More specifically, the thickness is set within a range of several Å and several thousands of Å, and preferably within a range of 10 Å and 500 Å.

An appropriate material is selected as the material for forming the fine-particle film from among metals, such as Pd, Pt, Ru, Ag, Au, Ti, In, Cu, Cr, Fe, Zn, Sn, Ta, W, Pb and the like, oxides such as PdO, $SnO_2$, $In_2O_3$, PbO, $Sb_2O_3$ and the like, Borides, such as $HfB_2$, $ZrB_2$, $LaB_6$, $CeB_6$, $YB_4$, $GdB_4$ and the like, carbides, such as TiC, ZrC, HfC, TaC, SiC, WC and the like, nitrides, such s TiN, ZrN, HfN and the like, semiconductors, such as Si, Ge and the like, carbon and the like.

As described above, the conductive thin film 1104 is provided in the form of a fine-particle film. The sheet resistance of the fine-particle film is set within a range of $10^3$ and $10^7$ Ω/sq.

Since it is desirable that the conductive thin film 1104 and the devices electrodes 1102 and 1103 are electrically connected excellently, a structure in which the conductive thin film 1104 is partially superposed on the device electrodes 1102 and 1103.

Although in FIG. 6B, the above-described films are laminated in the order of the substrate 1101, the device electrodes 1102 and 1103, and the conductive thin film 1104 from below, the films may be laminated in the order of the substrate 1101, the conductive thin film 1104 and the device electrodes 1102 and 1103 from below, depending on situations.

The electron emitting portion 1195 is a cracked portion formed at a portion of the conductive thin film 1104, and has a higher electric resistance than surrounding portions of the conductive thin film 1104. Cracks are formed by performing current-supply forming processing (to be described later) for the conductive thin film 1104.

Fine particles having particle diameters between several Å and several hundreds of Å are sometimes provided within the cracks. FIGS. 6A and 6B schematically illustrate the electron emitting portion since it is difficult to precisely and correctly depict the position and the shape of the actual electron emitting portion.

The thin film 1113 is made of carbon or a carbon compound, and covers the electron emitting portion 1105 and a surrounding portion thereof. The thin film 1113 is formed by performing current-supply activation processing (to be described later) after performing current-supply forming processing.

The thin film 1113 is made of one of single-crystal graphite, polycrystal graphite and amorphous carbon, or a mixture thereof, and has a thickness equal to or less than 500 Å, preferably, equal to or less than 300 Å.

Since it is difficult to precisely depict the position and the shape of the actual thin film 1113, FIGS. 6A and 6B schematically illustrate the thin film 1113. In the plan view in FIG. 6A, a device in which a part of the thin film 1113 is removed is depicted.

The basic configuration of a preferred device has been described. In this embodiment, the following devices are used.

That is, soda-lime glass is used as the substrate 1101, and Ni thin films are used as the device electrodes 1102 and 1103. The thickness d of the device electrodes 1102 and 1103 are 1,000 Å, and the distance L between the device electrodes 1102 and 1103 is 2 $\mu$m. Pd or PdO is used as the main material of the fine particle film, and the thickness and the width W of the fine-particle film are about 100 Å and 100 $\mu$m, respectively.

Next, a description will be provided of the method for manufacturing preferred flat-surface-type surface-conduction-type emitting devices. FIGS. 7A–7E are cross-sectional views illustrating processes for manufacturing each of surface-conduction-type emitting devices used in the electron-beam generation device shown in FIG. 1. In FIGS. 7A–7E, respective components are indicated by the same reference numerals as in FIGS. 6A and 6B.

Figure 7A:
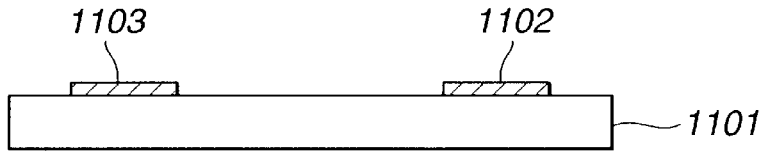
FIGS. 7A–7E are cross-sectional views illustrating a process for manufacturing the flat surface-conduction-type emitting device used in the electron-beam generation device shown in FIG. 1.

First, as shown in FIG. 7A, the device electrodes 1102 and 1103 are formed on the substrate 1101.

In this process, after sufficiently cleaning in advance the substrate 1101 using a detergent, pure water and an organic solvent, a material for the device electrodes 1102 and 1103 is deposited (the method of deposition may, for example, be a vacuum film forming technique, such as vacuum deposition, sputtering or the like).

Then, the deposited electrode material is subjected to patterning using photography and etching, to form a pair of device electrodes 1102 and 1103 shown in FIG. 7A.

Figure 7B:
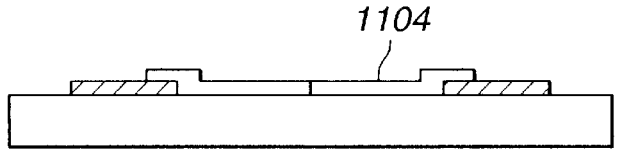

2) Then, as shown in FIG. 7B, the conductive film 1104 is formed. In this process, first, an organometallic solution is coated on the substrate obtained in the process shown in FIG. 7A and the coated solution is dried. After forming a fine-particle film by performing heating/firing processing, the formed film is patterned to a predetermined shape by photolithography and etching.

The organometallic solution is a solution of an organometallic compound including a material for fine particles used in the conductive thin film as the main element. More specifically, in this embodiment, Pd is used as the main element. Although in this embodiment, dipping is used as the coating method, any other appropriate method, such as a spinner method or a spray method, may also be used.

As for the method for forming the conductive thin film including fine particles, any appropriate method other than the method of coating the organometallic solution used in this embodiment, such as vacuum deposition, sputtering, CVD or the like, is sometimes used.

Figure 7C:
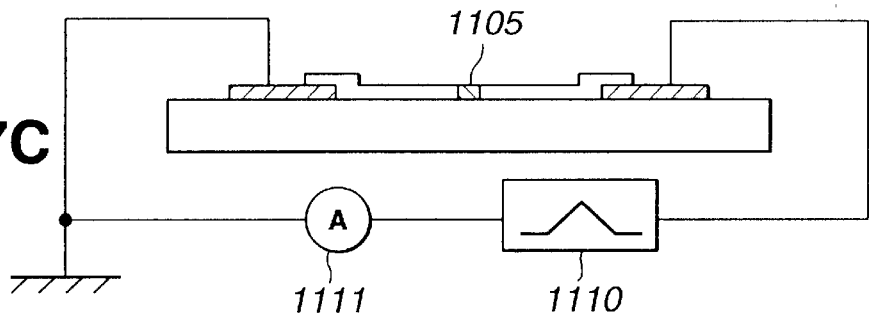

Then, as shown in FIG. 7C, by applying an appropriate voltage between the device electrodes 1102 and 1103 from a power supply for forming 1110, current-supply forming processing is performed to form the electron emitting portion 1105.

In the current-supply forming processing, the conductive thin film 1104 is changed into a structure suitable for performing electron emission by appropriately destructing, deforming or altering a portion of the conductive thin film 1104 including fine particles by supplying current.

In the portion of the conductive thin film 1104 changed into the structure suitable for performing electron emission (i.e., the electron emitting portion 1105), appropriate cracks are formed.

The electric resistance measured between the device electrodes 1102 and 103 greatly increases after forming the electron emitting device 1105.

Figure 8:
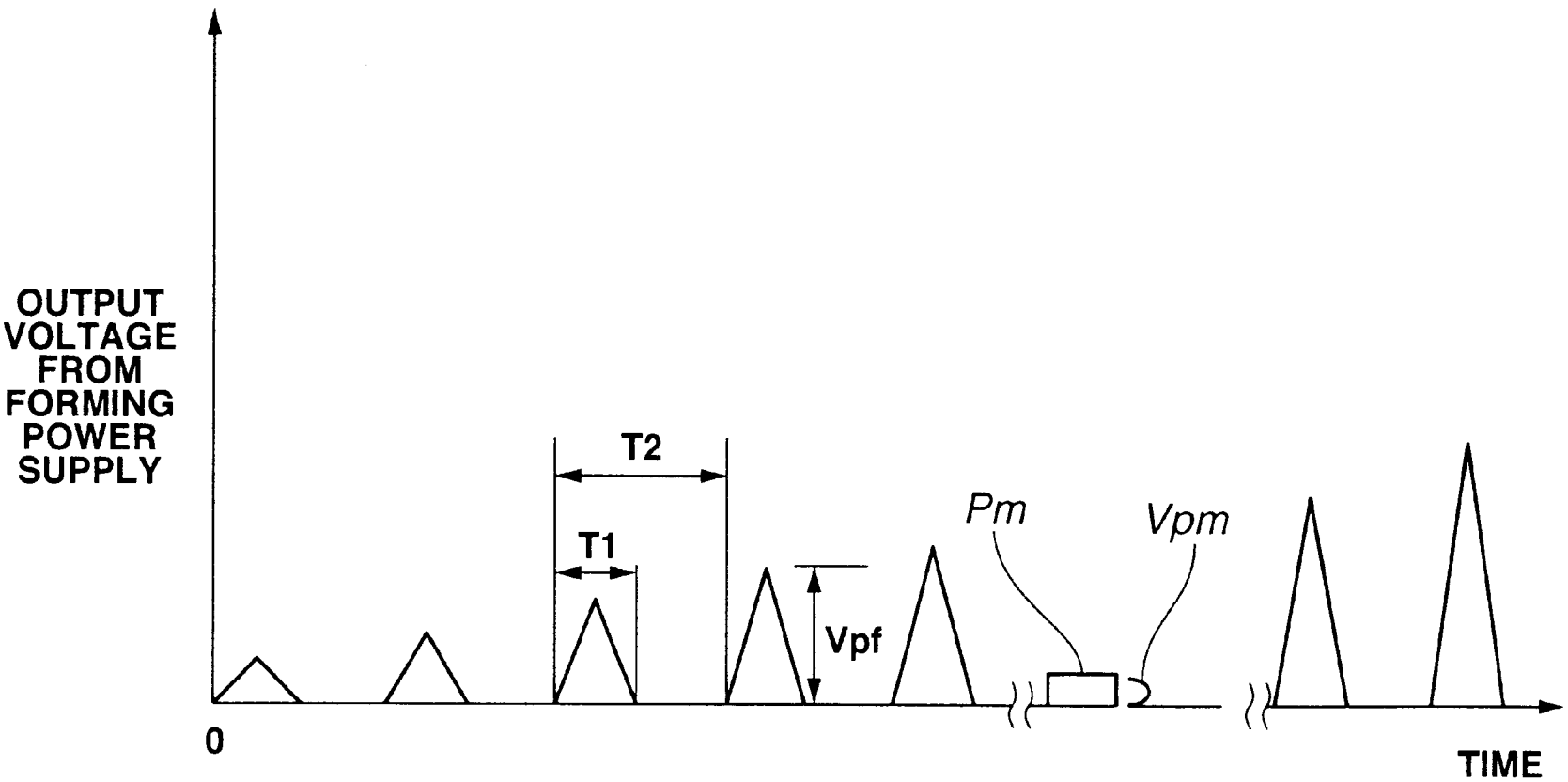
FIG. 8 is a graph illustrating the waveforms of applied voltages at current-supply forming processing for the electron-beam generation device shown in FIG. 1.

In order to explain the current supply method in more detail, FIG. 8 illustrates the waveforms of appropriate voltages applied to the electron-beam generation device shown in FIG. 1 from the power supply for forming 1110.

When performing forming processing for the conductive thin film 1104 including fine particles, pulse-shaped voltages are preferred. In this embodiment, as shown in FIG. 8, triangular pulses having a pulse width T1 are consecutively applied at a pulse interval T2. At that time, the peak value Vpf of the triangular pulse is sequentially increased.

A monitor pulse Pm for monitoring the state of formation of the electron emitting portion 1105 is inserted between the consecutive triangular pulses with an appropriate interval, and the current flown at that time is measured by an ammeter 1111.

In this embodiment, for example, in a vacuum atmosphere of about $10^{-3}$ Pa, the pulse width T1 and the pulse interval T2 are set to 1 msec and 10 msec, respectively, and the peak value Vpf is increased by 0.1 V at every pulse.

Every time five triangular pulses are applied, the monitor pulse Pm is inserted.

In order to prevent adverse influence on the forming processing, the voltage Vpm of the monitor pulse is set to 0.1 V.

When the electric resistance between the device electrodes 1102 and 1103 becomes $1\times10^{6}$ Ω, i.e., when the current measured by the ammeter 1111 during application of the monitor pulse becomes equal to or less than $1\times10^{-7}$ A, current supply for the forming processing is terminated.

The above-described method is preferable for the surface-conduction-type emitting devices of this embodiment. It is desirable to appropriately change current-supply conditions when the design of the surface-conduction-type emitting devices, such as the material and the thickness of the fine-particle film, the distance L between the device electrodes 1102 and 1103, and the like, has been changed.

Figure 7D:
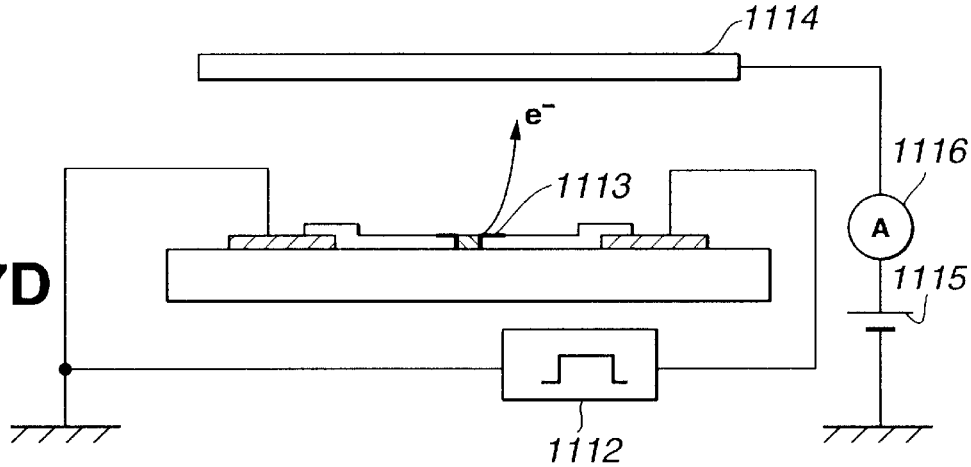

Then, as shown in FIG. 7D, by applying an appropriate voltage between the device electrodes 1102 and 1103 from a power supply for activation 1112, current-supply activation processing is performed to improve the electron emission characteristics.

In the current-supply activation processing, current is supplied for the electron emitting portion 1105 formed by the current-supply forming processing, to deposit carbon or a carbon compound on a portion near the electron emitting portion 1105. In FIG. 7D, a deposit comprising carbon or a carbon compound is schematically illustrated as the thin film 1113.

By performing the current-supply activation processing, it is possible to increase the emission current at the same applied voltage typically by at least 100 times compared with the current before performing the processing.

More specifically, by periodically applying a voltage pulse in a vacuum atmosphere within a range between $10^{-4}$ and $10^{-3}$ Pa, carbon or a carbon compound obtained from an organic compound present in the vacuum atmosphere is deposited.

The deposit 1113 is one of single-crystal graphite, polycrystalline graphite and amorphous graphite, or a mixture of these materials, and has a thickness equal to or less than 500 Å, more preferably, equal to or less than 300 Å.

Figure 9A:
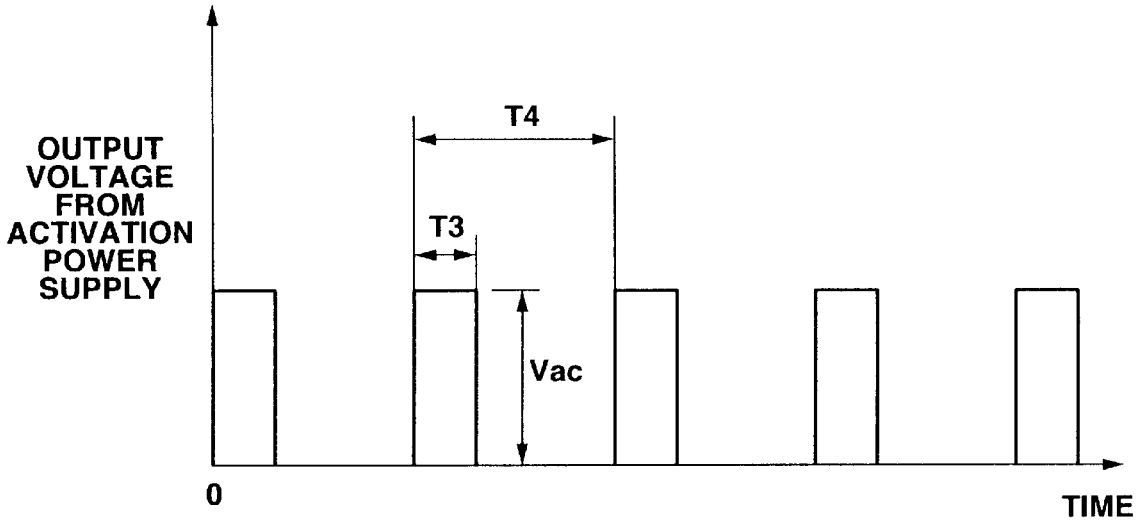
FIGS. 9A and 9B are graphs illustrating the waveforms of applied voltages, and changes in an emission current Ie, respectively, at current-supply activation processing for the electron-beam generation device shown in FIG. 1.

In order to explain the current-supply method in more detail, FIG. 9A illustrates the waveform of an appropriate voltage applied from a power supply for activation 1112 to the electron-beam generation device shown in FIG. 1.

In this embodiment, current-supply activation processing is performed by periodically applying a constant rectangular-wave voltage. More specifically, the rectangular-wave voltage Vac is 14 V, a pulse width T3 is 1 msec, and a pulse interval T4 is 10 msec.

The above-described current-supply conditions are preferable for the surface-conduction-type emitting devices of the embodiment. When changing the design of the surface-conduction-type emitting devices, it is desirable to appropriately change the conditions.

Reference numeral 1114 shown in FIG. 7D represents an anode electrode for catching emission current Ie emitted from the surface-conduction-type emitting device, and is connected to a DC high-voltage power supply 1115 and an ammeter 1116. (When performing activation processing after incorporating the substrate 1101 in the display panel, the phosphor surface of the display panel is used as the anode electrode 1114.)

While the voltage is applied from the power supply for activation 1112, the state of progress of the current-supply activation processing is monitored by measuring the emission current Ie by the ammeter 1116, whereby the operation of the power supply for activation 1112 is monitored.

Figure 9B:
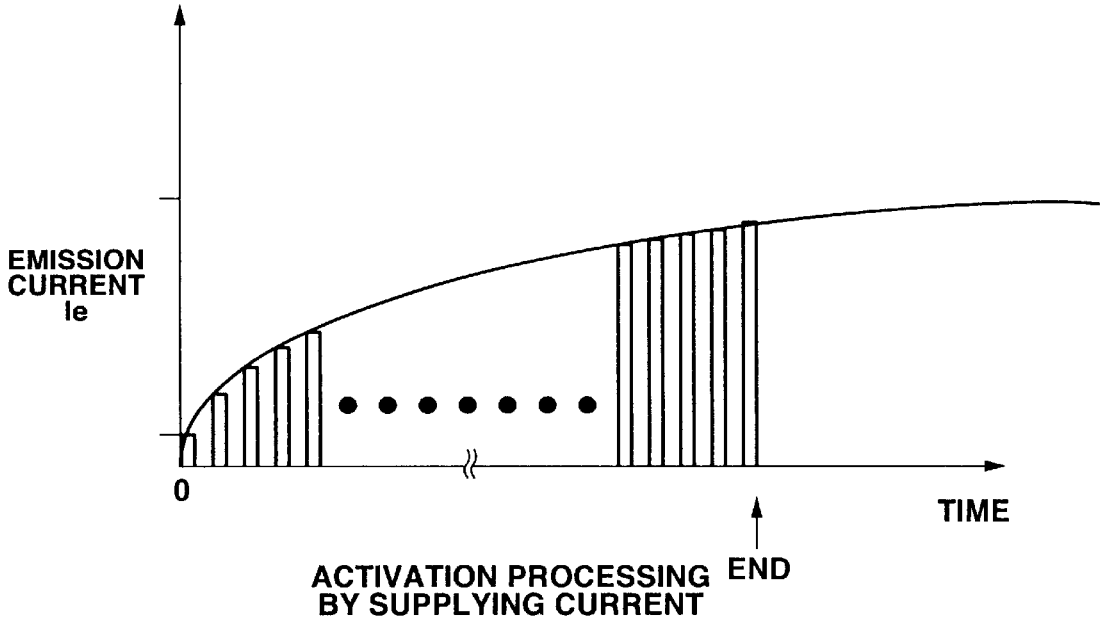

FIG. 9B illustrates an example of emission currents measured by the ammeter 1116. After the start of application of the pulse voltage from the power supply for activation 1112, the emission current Ie increases with the lapse of time, and then is saturated and hardly increases.

The application of the voltage from the power supply for activation 1112 is interrupted when the emission current Ie is substantially saturated, to terminate the current-supply activation processing.

The above-described current supply conditions are preferable for the surface-conduction-type emitting devices of the embodiment. When changing the design of the surface-conduction-type emitting devices, it is desirable to appropriately change the conditions.

Figure 7E:
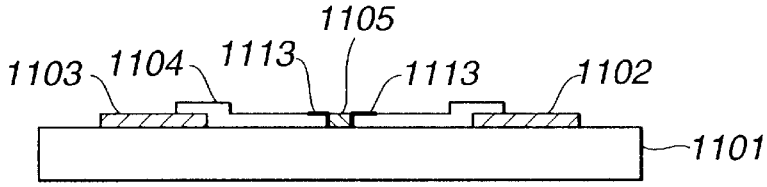

Flat-surface-type surface-conduction-type emitting devices, each as shown in FIG. 7E, have been manufactured in the above-described manner.

Specific examples of the present invention will now be described with reference to the drawings.

EXAMPLE 1

Figure 10:
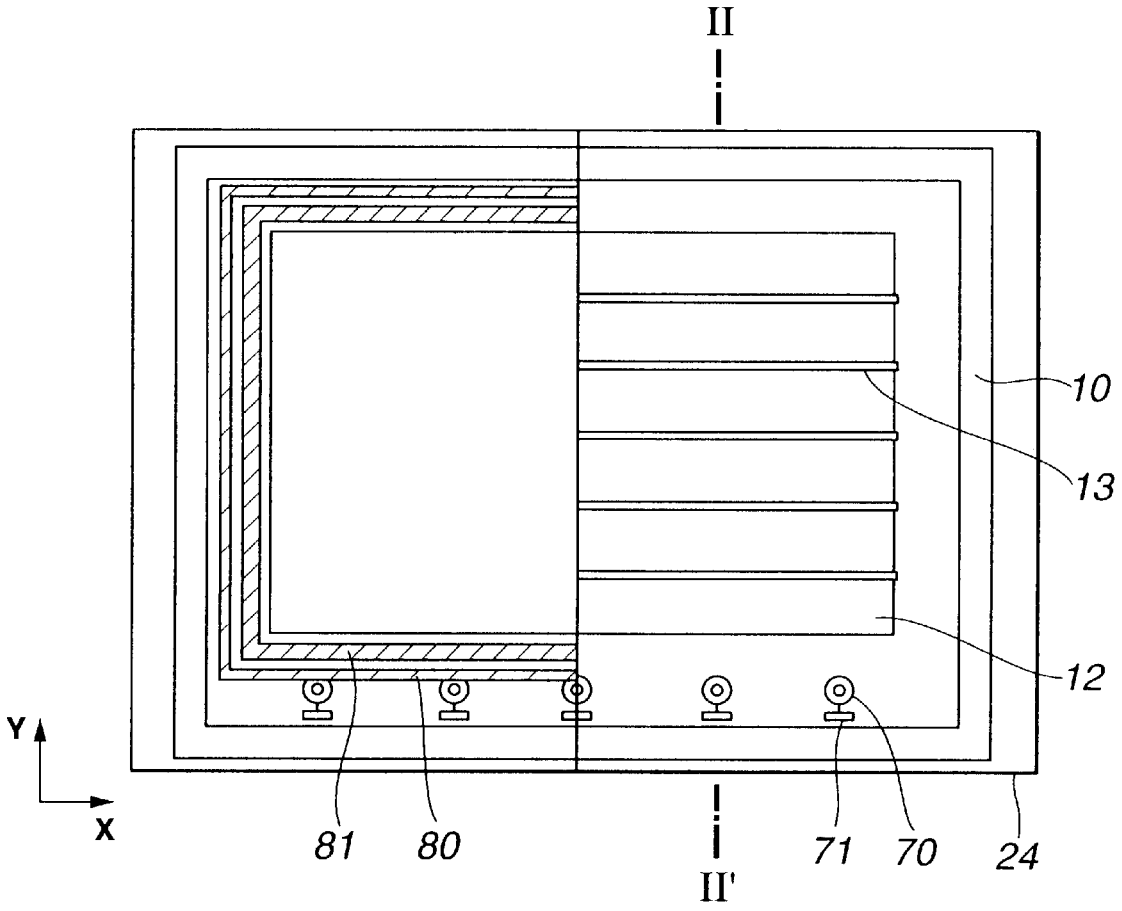
FIG. 10 is a schematic plan view illustrating a panel used in Example 1 of the electron-beam generation device of the invention.

Example 1 of the present invention will now be described. FIG. 10 is a schematic plan view illustrating Example 1 of the electron-beam generation device of the invention, as seen from above a faceplate.

Figure 11:
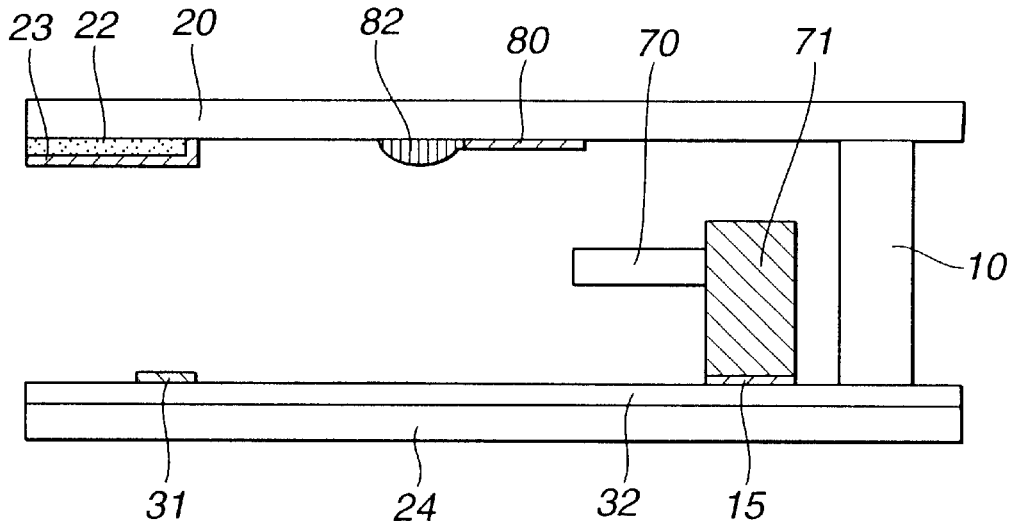
FIG. 11 is a cross-sectional view illustrating a surrounding portion of a getter supporting member, taken along line II–II' shown in FIG. 10.
Figure 12:
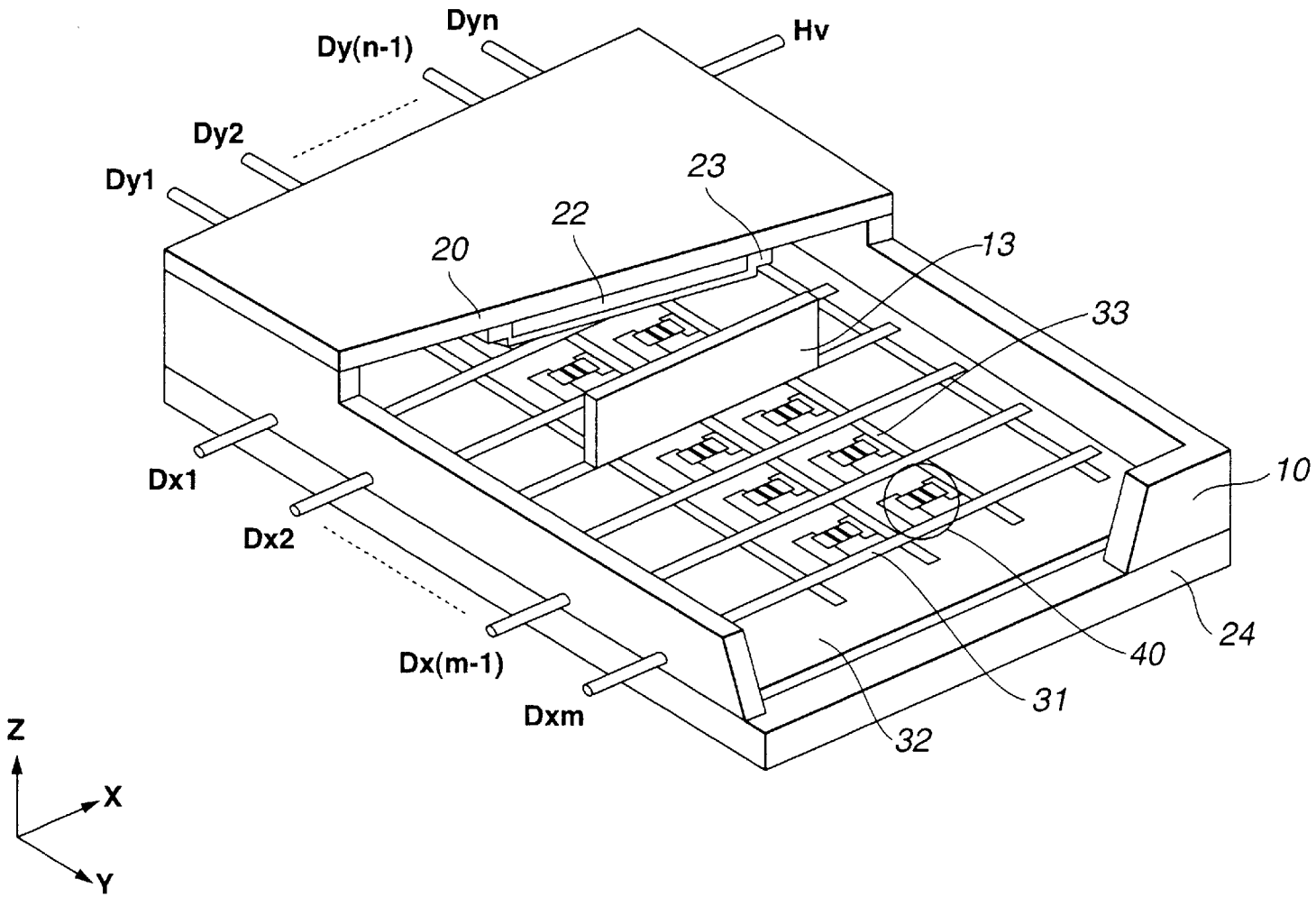
FIG. 12 is a perspective view obtained by partially cutting away a portion of the panel used in the electron-beam generation device shown in FIG. 10.

In order to facilitate understanding, the right half portion of the faceplate is omitted in FIG. 10. FIG. 11 is a cross-sectional view illustrating a surrounding portion of a getter supporting member shown in FIG. 10, taken along line II–II'. FIG. 12 is a partially broken perspective view of the electron-beam generation device of Example 1.

In FIGS. 10, 11 and 12, a substrate 32 on which a plurality of surface-conduction-type electron emitting devices 40 are arranged in the form of a matrix is fixed on a rear plate 24.

The surface-conduction-type electron emitting devices 40 are wired by row-direction wires 31 and column-direction wires 33.

The faceplate 20 and the rear plate 24 are subjected to airtight connection using a supporting frame 10, to provide an airtight container.

A black matrix (not shown), a phosphor 22, a metal back 23, an electrode (not shown) for regulating the potential of the metal back 23, and the like are provided on the faceplate 20.

A region between an anode-potential regulating region where the metal back 23 is provided and a region obtained by performing orthogonal projection of the anode-potential regulating region on the rear plate 24 is defined as an image region 12.

Spacers 13 are inserted between the faceplate 20 and the rear plate 24, on row-direction wires 31 as atmospheric-pressure supporting members. Various films may be formed on the surface of the spacer 13.

In Example 1, an antistatic high-resistance film is formed on the spacer 13, and a low-resistance film is formed on contact surfaces of the spacer 13 facing the metal back 23 and the row-direction wire 31 and side portions connected to the contact surfaces.

As shown in FIGS. 10 and 12, the spacers 13 are provided within the image region 12, and are fixed on the corresponding row-direction wires 31 using an adhesive. The spacers 13 may be fixed on the black matrix 21.

In FIGS. 10 and 11, getter members 70 and getter supporting members 71 for supporting the getter members 70 are formed at portions outside of the image region 12.

The getter members 71 are fixed on the rear plate 24 using an adhesive 15.

The getter supporting members 71 may be fixed on the faceplate 20. A low-resistance conductor 80, serving as a conductive member constituting the present invention, is formed so as to surround the anode-potential regulating region in order to suppress discharge from the getter members 70 and the getter supporting members 71, at a portion outside of the anode-potential regulating region which is a metal-back forming region on the inner surface of the faceplate 20.

A portion of the low-resistance conductor 80 is located at a position closer to the anode-potential regulating region than the getter members 70 and the getter supporting members 71, at orthogonal projection as seen from a direction perpendicular to the faceplate 20.

The low-resistance conductor 80 is connected to the ground via a connection terminal (not shown). A configuration in which a ground-connection wire is connected to the faceplate 20 may also be adopted.

A structure 82 which is convex with respect to the inner side of the vacuum container (hereinafter termed a "convex structure 82") is formed between the image region 12 and the low-resistance conductor 80.

A description will now be provided of the convex structure 82 which is a feature of Example 1, and a portion having a close relationship with the convex structure 82.

In Example 1, as shown in FIG. 11, the convex structure 82 is formed between the metal back 23, serving as an anode, and the low-resistance conductor 80, serving as a cathode, so as to be connected to the cathode. In the case of a structure in which a member providing an anode potential is present at a portion closer to the cathode than the metal back, the convex structure is provided between the member providing the anode potential and the low-resistance conductor.

The factors of suppression of discharge between the metal back 23 and the low-resistance conductor 80 by providing the convex structure 82 will now be described.

The first factor is an increase in the breakdown voltage of the surface by increasing the creeping distance. The creeping distance is a distance measured along the surface.

As a result, the size of the image forming apparatus can be reduced, so that the substantial distance between the metal back 23 and the low-resistance conductor 80 can be shortened.

The second factor is suppression of the probability of secondary electron emission by suppressing the incident energy at re-incidence of field emission electrons from the low-resistance conductor 80.

When it is necessary to increase the electron acceleration voltage Va in order to increase the display luminance of the image forming apparatus, discharge due to field emission electrons from the low-resistance conductor 80 causes a problem.

Accordingly, by causing field emission electrons to impinge upon the convex structure 82 before the field emission electrons are accelerated by the electric field to increase the energy and thereby greatly increase the secondary emission coefficient at re-incidence, the number of emission of secondary electrons at reemission is reduced, and the generation of multiply scattered secondary electrons is prevented.

The position of the convex structure 82 is desirably near the low-resistance conductor 80 where the energy of emitted electrons is low.

The height of the convex structure 82 is desirably equal to or higher than the maximum height of reemitted secondary electrons (the distance from FP) in order to reduce the probability of jumping of emitted electrons over the convex structure 82 without impinging thereupon. An appropriate height of the convex structure 82 differs depending on the configuration.

In Example 1, the height of the row-resistance conductor 80 is set to 0.1 $\mu$m, and the height of the convex structure 82 is set to 1 $\mu$m. The height of the convex structure 82 is preferably at least 1 $\mu$m. Particularly, in Example 1, the metal back constituting the anode-potential regulating region and the conductor member surrounding it are formed on the same surface, providing a structure in which the metal back can be seen from the conductive member if the convex structure is absent. In this structure, by providing the convex structure on the same surface, undesirable discharge can be excellently suppressed.

The low-resistance conductor 80 is formed by sputtering using Pt and Ti. The convex structure 82 is formed by performing spray coating of polybenzimidazole (PBI) followed by heat treatment at 300° C.

A material having a sufficiently low resistance may be selected as the material for the low-resistance conductor 80. For example, a metal such as Ni, Cr, Au, Mo, W, Pt, Ti, Al, Cu, Pd or the like, or an alloy of some of these metals may be appropriately selected.

The low-resistance conductor 80 may be formed according to sputtering, electron-beam vacuum deposition, ion plating, ion assisting vacuum deposition or the like.

Although each type of material other than PBI may be used as the material for the convex structure 82, the material must have a high insulating property, and a high heat-resisting property to resist against heat at a thermal process when forming the display panel.

EXAMPLE 2

Figure 13:
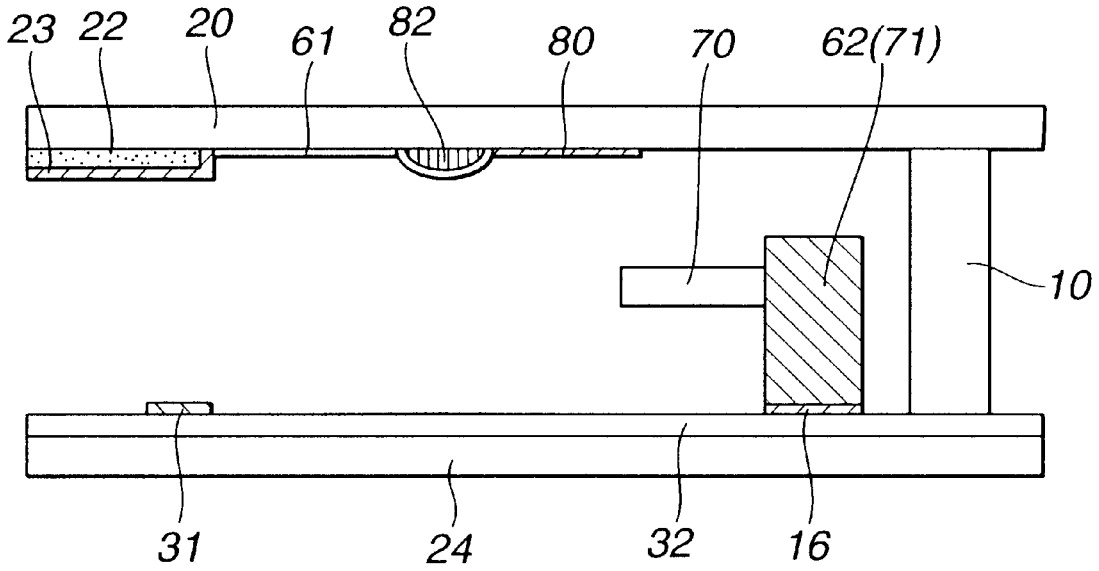
FIG. 13 is a cross-sectional view illustrating a surrounding portion of the getter supporting member, taken along line II–II' shown in FIG. 10, in Example 2 of the electron-beam generation device of the invention.

In Example 2, serving as a modification of the above-described Example 1, as shown in FIG. 13, a high-resistance film 61 may be formed on the surface between a metal back 23 and a low-resistance conductor 80. FIG. 13 is a cross-sectional view illustrating a surrounding portion of the getter supporting member taken along line II–II' shown in FIG. 10, in Example 2 of the electron-beam generation device of the present invention.

Charging caused by electrons emitted from the low-resistance conductor 80 or ions produced by the emitted electrons can be prevented by causing a small current to flow in the high-resistance film 61.

It can be considered that in the above-described Examples 1 and 2, by adopting the configuration shown in FIG. 11 for the gap between the metal back 23 and the low-resistance conductor 80, discharge is prevented by increasing the creeping distance and suppressing electron emission from the low-resistance conductor 80.

When an electron acceleration voltage has been applied by setting the gap between the metal back 23 and the low-resistance resistance 80 to 2 mm, a voltage against discharge of 14 kV has been confirmed.

An image forming apparatus using the electron-beam generation device manufactured in the above-described manner could display an excellent-quality image free from discharge and having a high luminance.

EXAMPLE 3

Figure 14:
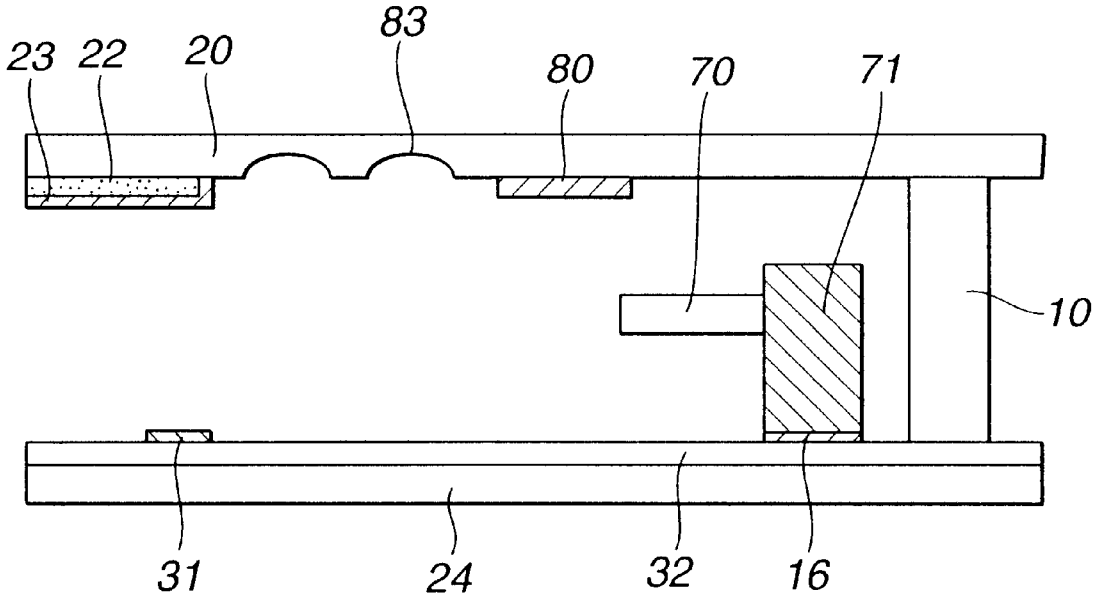
FIG. 14 is a cross-sectional view illustrating a surrounding portion of the getter supporting member, taken along line II–II' shown in FIG. 10, in Example 3 of the electron-beam generation device of the invention.

Next, Example 3 of the electron-beam generation device of the present invention will be described. FIG. 14 is a cross-sectional view illustrating a surrounding portion of the getter supporting member taken along line II–II' shown in FIG. 10, in Example 3 of the electron-beam generation device of the present invention. Only portions different from Example 1 will be described.

In Example 3, as shown in FIG. 14, a structure 83 which is concave with respect to the inner side of a vacuum container (hereinafter termed a "concave structure 83") is provided at a portion (a region 81 shown in FIG. 10) between a metal back 23, serving as an anode, and a low-resistance conductor 80, serving as a cathode.

By providing the concave structure 83, the voltage against discharge on the surface can be increased by increasing the creeping distance as in Example 1.

In Example 3, the concave structure 83 is formed by cutting the faceplate 20 to a depth of 20 $\mu$m. The concave structure may also be formed by etching or the like.

It can be considered that by adopting the configuration shown in FIG. 14 for the gap between the metal back 23 and the low-resistance conductor 80, discharge is prevented by increasing the creeping distance.

When an electron acceleration voltage has been applied by setting the gap between the metal back 23 and the low-resistance resistance 80 to 2 mm, a voltage against discharge of 14 kV has been confirmed.

An image forming apparatus using the electron-beam generation device manufactured in the above-described manner could display an excellent-quality image free from discharge and having a high luminance.

In Example 3, also, it is particularly preferable to provide a resistive film for electrically connecting the metal back 23 to the low-resistance-conductor 80.

EXAMPLE 4

Figure 15:
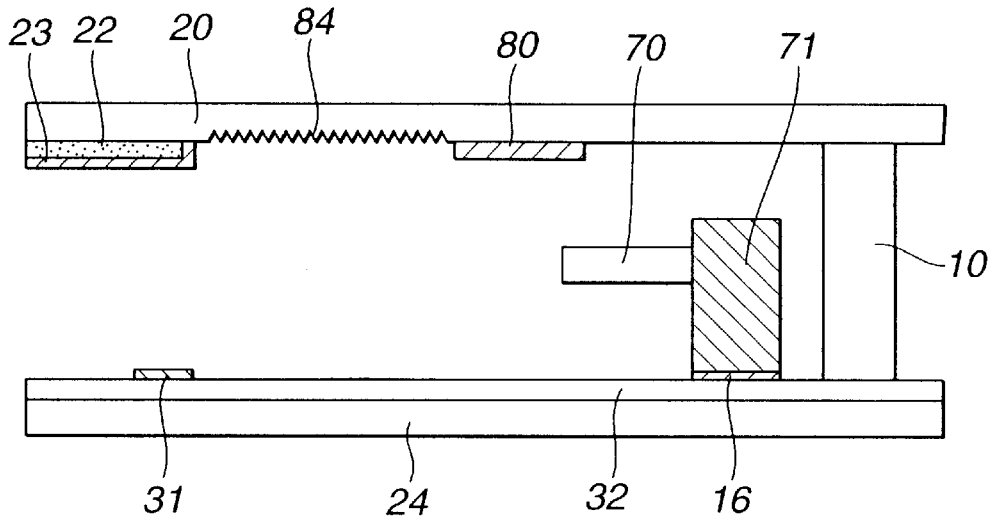
FIG. 15 is a cross-sectional view illustrating a surrounding portion of the getter supporting member, taken along line II–II' shown in FIG. 10, in Example 4 of the electron-beam generation device of the invention.

FIG. 15 is a cross-sectional view illustrating a surrounding portion of the getter supporting member taken along line II–II' shown in FIG. 10, in Example 4 of the electron-beam generation device of the present invention. Only portions different from Example 1 will be described.

In Example 4, as shown in FIG. 15, a structure 84 in which at least one pair of protrusion and recess is consecutively provided (hereinafter termed a "protrusion-and-recess structure 84") is provided at a portion (the region 81 shown in FIG. 10) between a metal back 23, serving as an anode, and a low-resistance conductor 80, serving as a cathode.

Factors of suppression of discharge between the metal back 23 and the low-resistance conductor 80 by providing the protrusion-and-recess structure 84 will now be described.

The first factor is an increase in the breakdown voltage on the surface by increasing the creeping distance, as in Examples 1 and 2.

The second factor is suppression of secondary electron emission by mitigating the dependency of field emission electrons from the low-resistance conductor 80 on the incident angle onto the surface of the faceplate.

First, incidence of electrons subjected to field emission from the point of concentration of the electric field near the contact point of the low-resistance conductor 80 (cathode) onto the surface of the faceplate can be considered. The incident angle of this path has distribution. Usually, a high electric field of about several to several tens of kV/cm is applied in the direction of the surface as an acceleration voltage. Hence, there exist electrons having high angles of incidence.

Accordingly, effective charge injection is performed by positive charges formed within the solid by incident electrons having high angles of incidence. If electrons are obliquely incident, the distribution of positions of generation of secondary electrons moves to a thin portion near the surface. As a result, the ratio of emission of electrons in the vacuum without disappearing by recombination increases, thereby increasing positive charges. This is a main cause for positive charges at the faceplate.

If distribution in the incident angle is provided in the direction of the normal of the interface which is deemed as the surface, the locally defined incident angle has distribution with respect to the macroscopically defined angle. Hence, the dependency of the coefficient of secondary electron emission on the incident angel is mitigated. Since the dependency on the incident angle greatly increases near incidence at 90 degrees, the effect of mitigating the dependency by dispersing the incident angle is great.

Accordingly, by providing the surface of the faceplate with the protrusion-and-recess structure, the above-described multiple scattering can be prevented. As a result, discharge between the anode and the cathode on the faceplate can be suppressed.

In Example 4, the protrusion-and-recess structure 84 having an average roughness of the surface of 100 angstroms is formed by sandblasting the faceplate 20. The protrusion-and-recess structure 84 may also be formed using sandpaper.

It can be considered that by adopting the configuration shown in FIG. 15 for the gap between the metal back 23 and the low-resistance conductor 80, discharge is prevented by increasing the creeping distance and suppressing secondary electron emission.

When an electron acceleration voltage has been applied by setting the gap between the metal back 23 and the low-resistance resistance 80 to 2 mm, a voltage against discharge of 14 kV has been confirmed.

An image forming apparatus using the electron-beam generation device manufactured in the above-described manner could display an excellent-quality image free from discharge and having a high luminance.

In Example 4, also, a configuration in which charging is prevented by electrically connecting the metal back 23 to the low-resistance-conductor 80 via a resistive film to cause a small current to flow in the resistive film is preferable.

EXAMPLE 5

Figure 16:
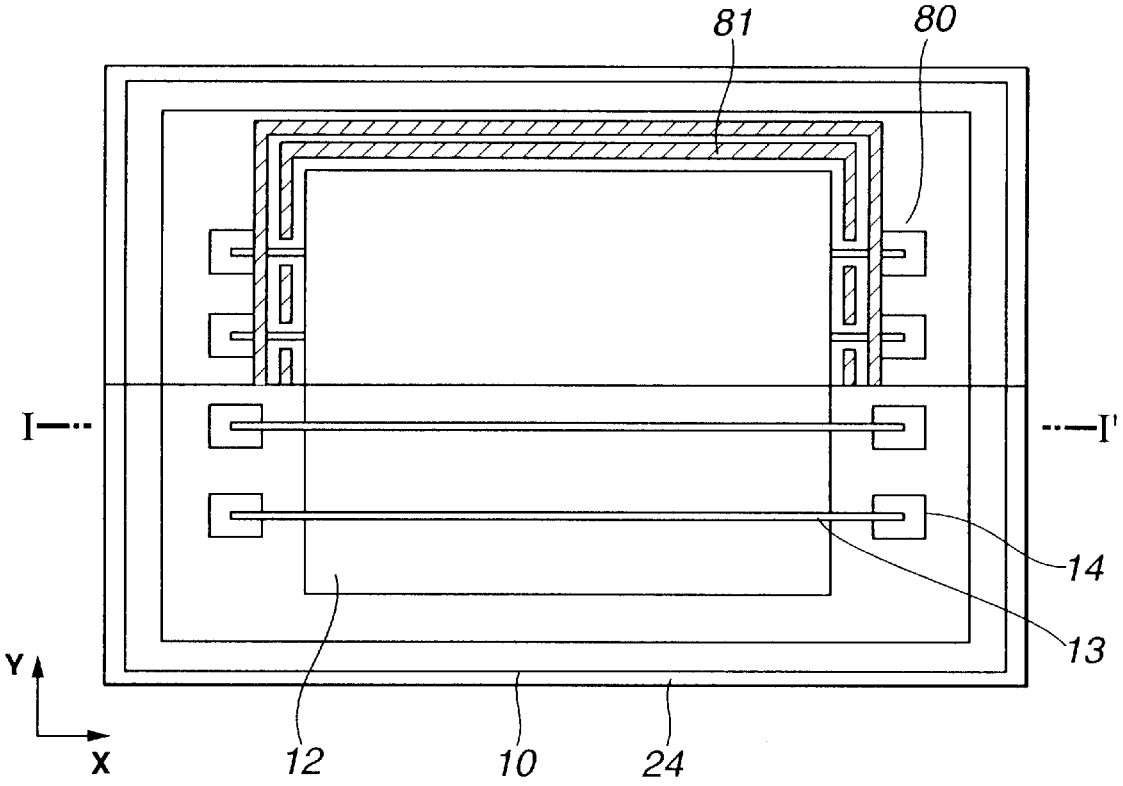
FIG. 16 is a schematic plan view obtained by partially cutting away a portion of a panel in Example 5 of the electron-beam generation device of the invention.
Figure 17:
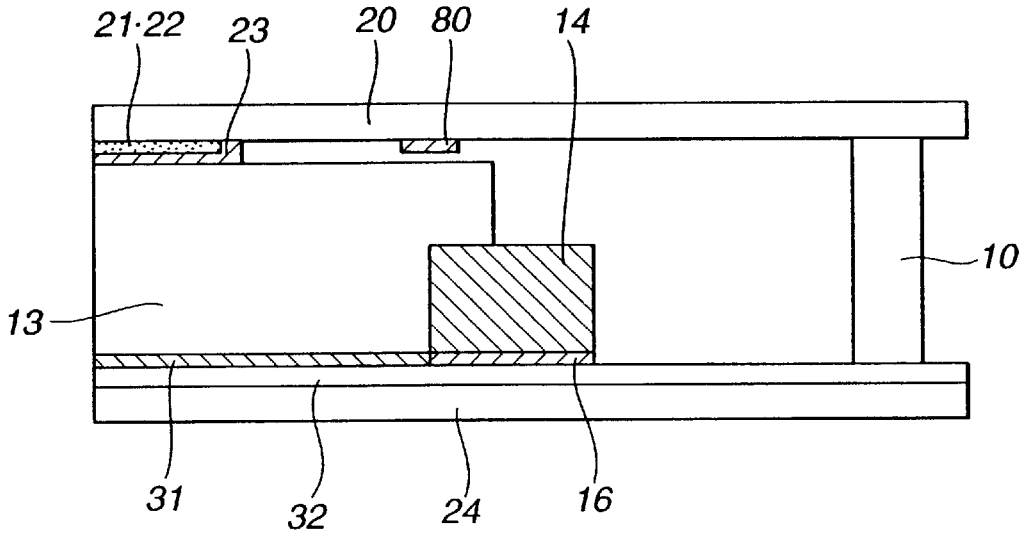
FIG. 17 is a cross-sectional view illustrating a surrounding portion of a spacer fixing member, taken along line I–I' shown in FIG. 16.
Figure 18:
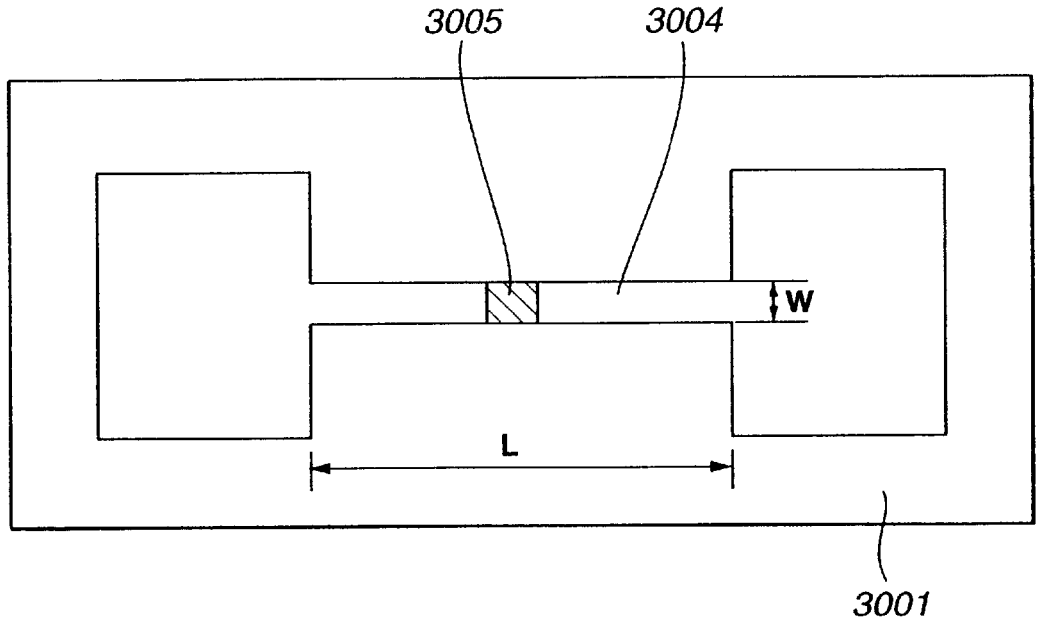
FIG.18 PRIOR ART
FIG. 18 is a schematic plan view illustrating a conventional surface-conduction-type emitting device.
Figure 19:
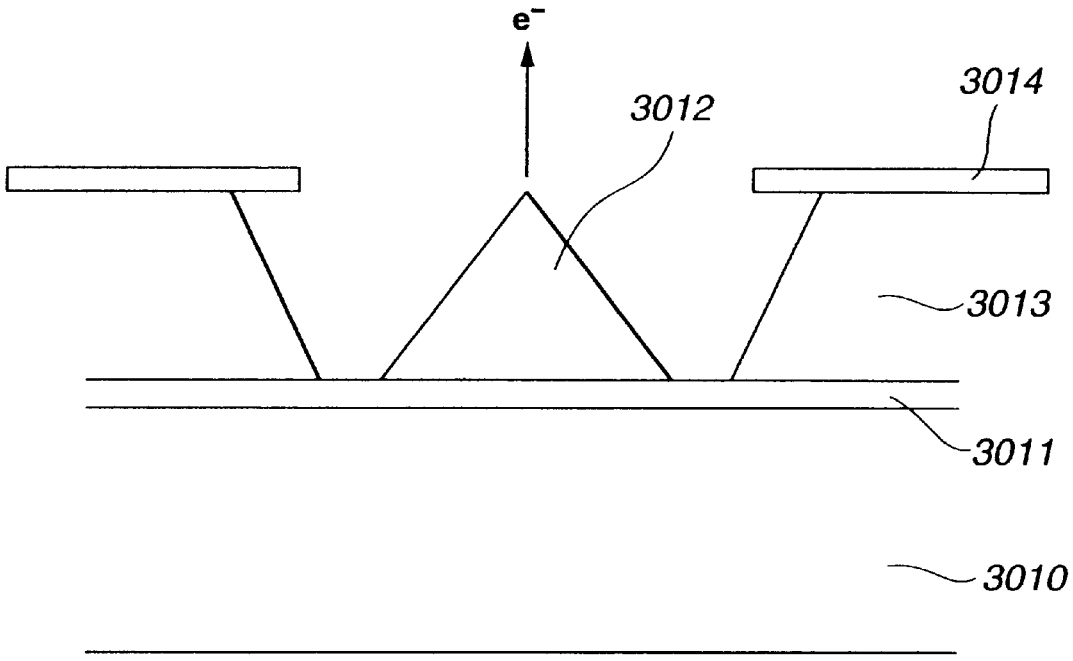
FIG.19 PRIOR ART
FIG. 19 is a schematic cross-sectional view illustrating a conventional FE-type device.
Figure 20:
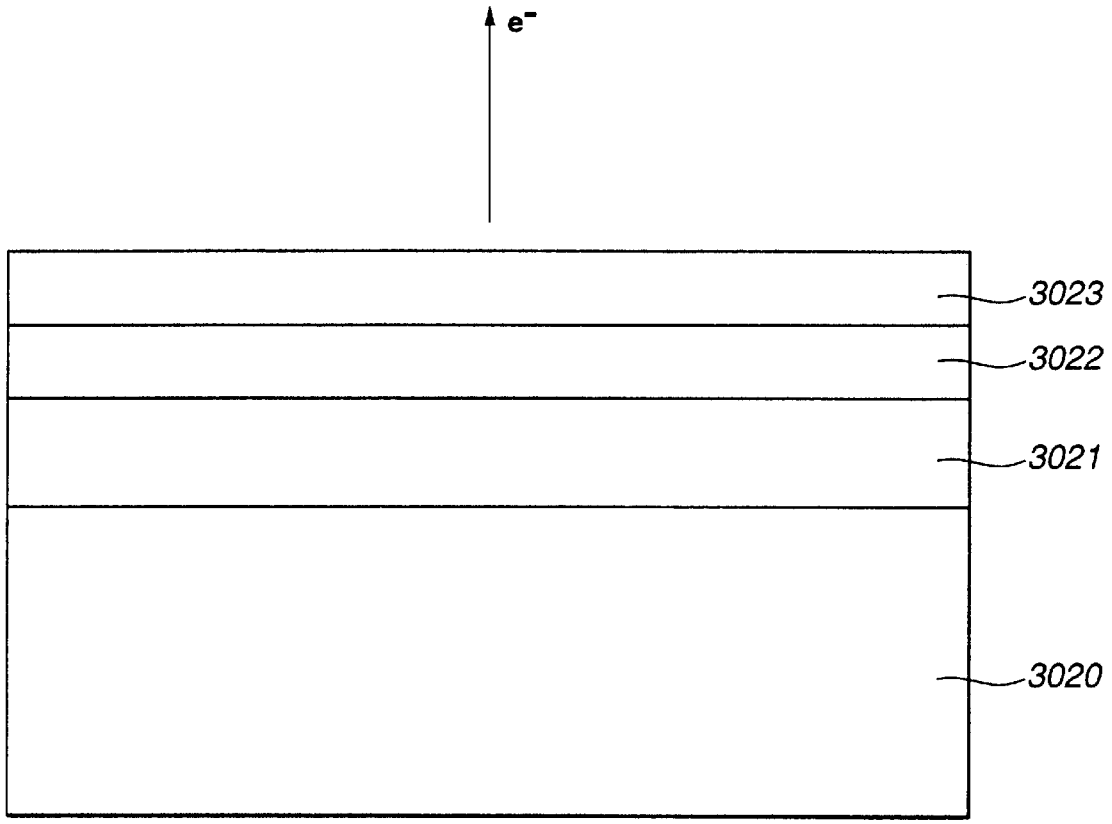
FIG.20 PRIOR ART
FIG. 20 is a schematic cross-sectional view illustrating a conventional MIM-type device.
Figure 21:
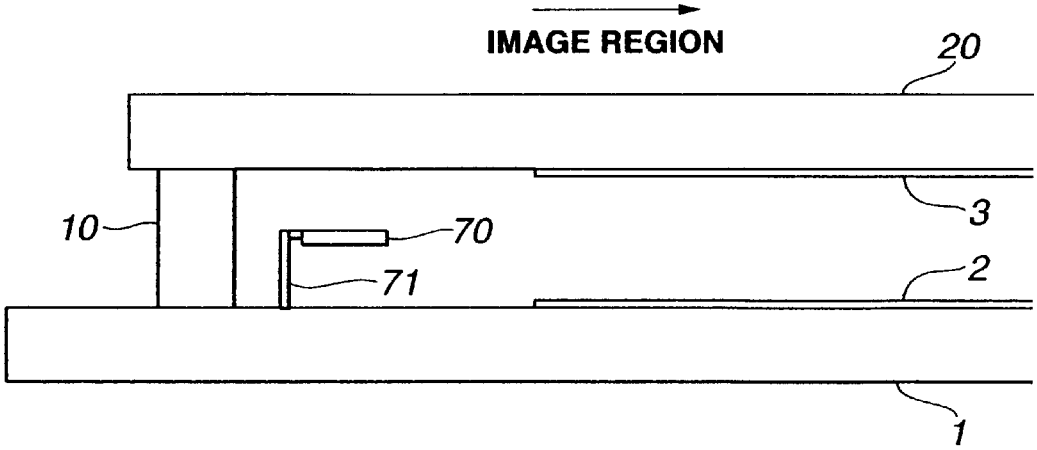
FIG.21 PRIOR ART
FIG. 21 is a schematic cross-sectional view illustrating a getter portion of a conventional electron-beam generation device.
Figure 22:
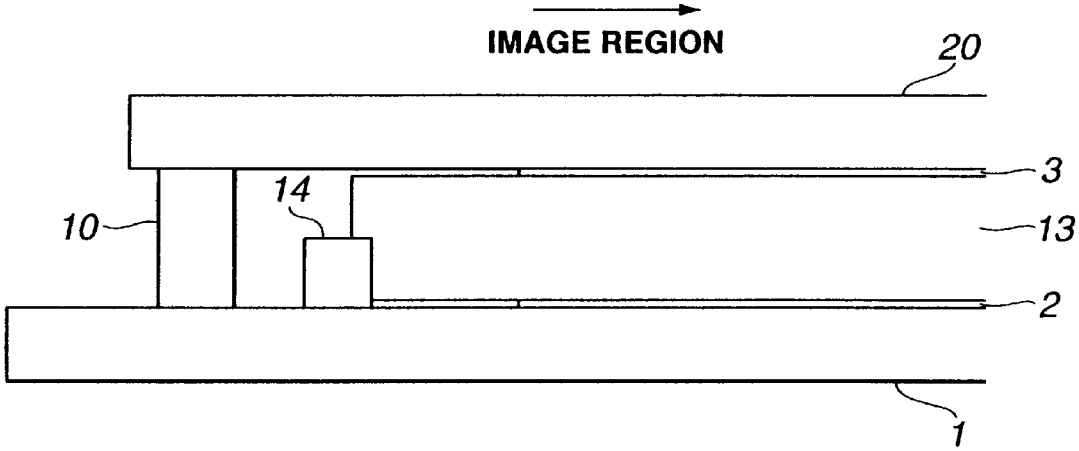
FIG.22 PRIOR ART
FIG. 22 is a schematic cross-sectional view illustrating a spacer supporting portion of a conventional electron-beam generation device.
Figure 23:
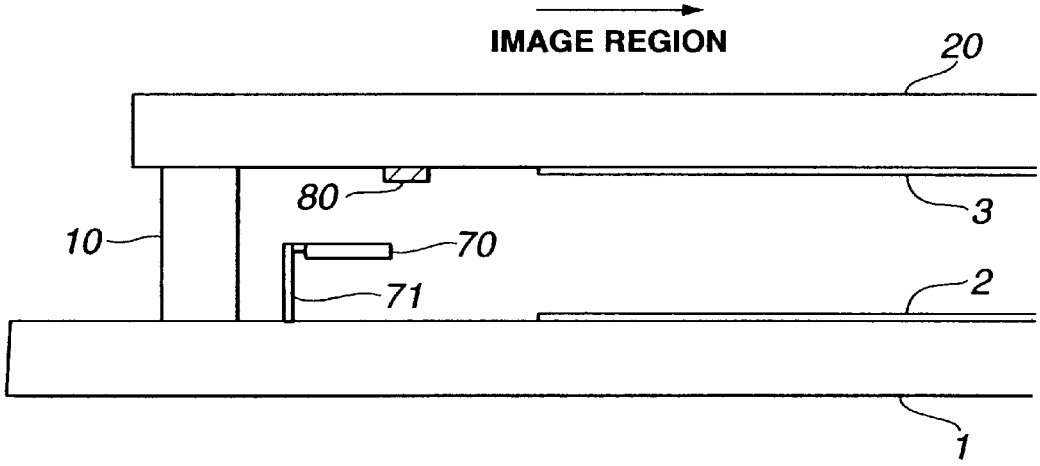
FIG.23 PRIOR ART
FIG. 23 is a schematic cross-sectional view illustrating a getter portion of a conventional electron-beam generation device.

Next, a description will be provided of Example 5 of the electron-beam generation device of the present invention. FIG. 16 is a schematic plan view of a panel of Example 5, illustrating the configuration as seen from above a faceplate. FIG. 17 is a cross-sectional view illustrating a surrounding portion of a spacer fixing member, taken along line I–I' shown in FIG. 16.

In order to facilitate understanding, the lower half surface of the faceplate is removed. Only portions different from Example 1 will be described.

As shown in FIGS. 16 and 17, both ends of each spacer 13 are extended to the outside of an image region 12. The spacer 13 is fixed at predetermined positions within a supporting frame 10 by spacer fixing members 14.

A groove for vertically standing the spacer 13 is formed in the spacer fixing member 14. The spacer fixing members 14 are fixed to both ends of the spacer 13, and are fixed on a rear plate 24 or a faceplate 20 using an adhesive 15.

In Example 5, as shown in FIG. 16, the convex structure as shown in Example 1 is not formed only at locations at the external circumference of the image region where the spacers 13 are disposed.

By adopting the same configuration as in Example 1 at portions where the convex structure does not interfere with the spacers 13, while preventing interference between the convex structure and the spacers 13, discharge at the gap between the metal back 23 and the low-resistance conductor 80 is suppressed.

When an electron acceleration voltage has been applied by setting the gap between the metal back 23 and the low-resistance resistance 80 to 2 mm, a voltage against discharge of 14 kV has been confirmed.

An image forming apparatus using the electron-beam generation device manufactured in the above-described manner could display an excellent-quality image free from discharge and having a high luminance.

In Example 5, also, it is particularly preferable to provide a resistive film for electrically connecting the metal back 23 to the low-resistance-conductor 80.

According to the configuration of each of the above-described examples, by providing multiple-scattering suppression means between the metal back (anode) formed on the faceplate and the conductive member (cathode) formed outside of the image region, it is possible to suppress secondary electron emission and discharge. By providing the resistive film so as to contact the anode-potential regulating region and the conductive member, it is possible to particularly excellently suppress discharge. By suppressing discharge, it is possible to provide an electron-beam emission device and an image display apparatus which can display an image having excellent display quality with a high luminance.

As described in the foregoing examples, according to the present invention, it is possible to realize an electron-beam generation device and an image forming apparatus in which undesirable discharge is suppressed.

The individual components shown in outline in the drawings are all well known in the electron-beam generation device and image display apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electron-beam generation device comprising:

an electron-source substrate having electron emitting devices; and a facing substrate disposed so as to face said electron-source substrate, wherein an anode-potential regulating region which a potential to accelerate electrons emitted from said electron emitting devices is applied on, a conductive member, disposed around said anode-potential regulating region with a predetermined interval therewith, which a predetermined potential is applied on, a resistive film contacting said anode-potential regulating region and said conductive member, and a protrusion, positioned between said anode-potential regulating region and said conductive member, which is convex with respect to said electron-source substrate are provided on said facing substrate.

2. An electron-beam generation device according to claim 1, wherein a height of said protrusion is at least 1 $\mu$m.

3. An electron-beam generation device according to claim 1, wherein said protrusion is disposed so as to surround at least three sides of said anode-potential regulating member.

4. An electron-beam generation device according to claim 1, further comprising a spacer provided between said electron-source substrate and said facing substrate so as to maintain an interval between said electron-source substrate and said facing substrate, wherein at least part of said spacer or a member for fixing said spacer is present outside of said anode-potential regulating region, and wherein said protrusion is formed at a portion other than a portion where said spacer or said member for fixing said spacer is formed.

5. An electron-beam generation device according to claim 1, wherein said conductive member is disposed so as to completely surround said anode-potential regulating region.

6. An electron-beam generation device according to claim 1, wherein a sheet resistance of said resistive film is within a range equal to or more than $1\times10^{7}$ Ω/□ and equal to or less than $1\times10^{14}$ Ω/□.

7. An electron-beam generation device according to claim 1, wherein each of the electron emitting devices is a cold-cathode device.

8. An electron-beam generation device according to claim 1, wherein each of the electron emitting devices is a surface-conduction-type electron emitting device.

9. An electron-beam generation device according to claim 1, wherein a voltage applied between said anode-potential regulating region and electrodes on a surface of said electron-source substrate having the electron emitting devices is at least 3 kV.

10. An electron-beam generation device according to claim 1, wherein a potential lower than said anode potential is applied on said conductive member.

11. An electron-beam generation device according to claim 1, wherein a cathode potential is applied on said conductive member.

12. An electron-beam generation device according to claim 1, wherein a ground potential is applied on said conductive member.

13. An electron-beam generation device comprising:

an electron-source substrate having electron emitting devices; and a facing substrate disposed so as to face said electron-source substrate, wherein an anode-potential regulating region which a potential to accelerate electrons emitted from said electron emitting devices is applied on, a conductive member, disposed around said anode-potential regulating region with a predetermined interval therewith, which a predetermined potential is applied on, a resistive film contacting said anode-potential regulating region and said conductive member, and a recess, positioned between said anode-potential regulating region and said conductive member, which is concave with respect to said electron-source substrate is provided on said facing substrate.

14. An electron-beam generation device according to claim 13, wherein said recess is disposed so as to surround at least three sides of said anode-potential regulating member.

15. An electron-beam generation device according to claim 13, further comprising a spacer provided between said electron-source substrate and said facing substrate so as to maintain an interval between said electron-source substrate and said facing substrate, wherein at least part of said spacer and a members for fixing said spacer is present outside of said anode-potential regulating region, and wherein said recess is formed at a portion other than a portion where said spacer or said member for fixing said spacer is formed.

16. An electron-beam generation device according to claim 13, wherein said conductive member is disposed so as to completely surround said anode-potential regulating region.

17. An electron-beam generation device according to claim 13, wherein a sheet resistance of said resistive film is within a range equal to or more than $1\times10^{7}$ Ω/□ and equal to or less than $1\times10^{14}$ Ω/□.

18. An electron-beam generation device according to claim 13, wherein each of the electron emitting devices is a cold-cathode device.

19. An electron-beam generation device according to claim 13, wherein each of the electron emitting devices is a surface-conduction-type electron emitting device.

20. An electron-beam generation device according to claim 13, wherein a voltage applied between said anode-potential regulating region and electrodes on a surface of said electron-source substrate having the electron emitting devices is at least 3 kV.

21. An electron-beam generation device according to claim 13, wherein a potential lower than said anode potential is applied on said conductive member.

22. An electron-beam generation device according to claim 13, wherein a cathode potential is applied on said conductive member.

23. An electron-beam generation device according to claim 13, wherein a ground potential is applied on said conductive member.

24. An electron-beam generation device comprising:

an electron-source substrate having electron emitting devices; and a facing substrate disposed so as to face said electron-source substrate, wherein an anode-potential regulating region which a potential to accelerate electrons emitted from said electron emitting devices is applied on, a conductive member, disposed around said anode-potential regulating region with a predetermined interval therewith, which a predetermined potential is applied on, a resistive film contacting said anode-potential regulating region and said conductive member, and protrusions and recesses positioned between said anode-potential regulating region and said conductive member are provided on said facing substrate.

25. An electron-beam generation device according to claim 24, wherein said protrusions and recesses are disposed so as to surround at least three sides of said anode-potential regulating member.

26. An electron-beam generation device according to claim 24, wherein each of the electron emitting devices is a surface-conduction-type electron emitting device.

27. An electron-beam generation device according to claim 24, further comprising a spacer provided between said electron-source substrate and said facing substrate so as to maintain an interval between said electron-source substrate and said facing substrate, wherein at least part of said spacer and a member for fixing said spacer is present outside of said anode-potential regulating region, and wherein said protrusions and recesses are formed at a portion other than a portion where said spacer or said member for fixing said spacer is formed.

28. An electron-beam generation device according to claim 24, wherein said conductive member is disposed so as to completely surround said anode-potential regulating region.

29. An electron-beam generation device according to claim 24, wherein a sheet resistance of said resistive film is within a range equal to or more than $1\times10^7$ Ω/□ and equal to or less than $1\times10^{14}$ Ω/□.

30. An electron-beam generation device according to claim 24, wherein a voltage applied between said anode-potential regulating region and electrodes on a surface of said electron-source substrate having the electron emitting devices is at least 3 kV.

31. An electron-beam generation device according to claim 24, wherein each of the electron emitting devices is a cold-cathode device.

32. An electron-beam generation device according to claim 24, wherein a potential lower than said anode potential is applied on said conductive member.

33. An electron-beam generation device according to claim 24, wherein a cathode potential is applied on said conductive member.

34. An electron-beam generation device according to claim 24, wherein a ground potential is applied on said conductive member.

35. An electron-beam generation device comprising:

an electron-source substrate having electron emitting devices; and a facing substrate disposed so as to face said electron-source substrate, wherein an anode-potential regulating region which a potential to accelerate electrons emitted from said electron emitting devices is applied on, and a conductive member, disposed around said anode-potential regulating region with a predetermined interval therewith, which a predetermined potential is applied are provided on a same surface of said facing substrate facing said electron-source substrate, and wherein a multiple-scattering suppression structure for suppressing multiple scattering of secondary electrons generated by electrons emitted from said conductive member is disposed between said anode-potential regulating region and said conductive member on the same surface.

36. An electron-beam generation device according to claim 35, wherein said conductive member is disposed so as to completely surround said anode-potential regulating region.

37. An electron-beam generation device according to claim 35, wherein a sheet resistance of said resistive film is within a range equal to or more than $1\times10^7$ Ω/□ and equal to or less than $1\times10^{14}$ Ω/□.

38. An electron-beam generation device according to claim 35, wherein each of the electron emitting devices is a cold-cathode device.

39. An electron-beam generation device according to claim 35, wherein a cathode potential is applied on said conductive member.

40. An electron-beam generation device according to claim 35, wherein each of the electron emitting devices is a surface-conduction-type electron emitting device.

41. An electron-beam generation device according to claim 35, wherein a voltage applied between said anode-potential regulating region and electrodes on a surface of said electron-source substrate having the electron emitting devices is at least 3 kV.

42. An electron-beam generation device according to claim 35, wherein a potential lower than said anode potential is applied on said conductive member.

43. An electron-beam generation device according to claim 35, wherein a ground potential is applied on said conductive member.

44. An image forming apparatus comprising:

an electron-source substrate having electron emitting devices; and a facing substrate disposed so as to face said electron-source substrate, wherein an anode-potential regulating region which a potential to accelerate electrons emitted from said electron emitting devices is applied on, phosphors for emitting light by electrons emitted from the electron emitting devices, a conductive member, disposed around said anode-potential regulating region with a predetermined interval therewith, which a predetermined potential is applied on, a resistive film contacting said anode-potential regulating region and said conductive member, and a protrusion, positioned between said anode-potential regulating region and said conductive member, which is convex with respect to said electron-source substrate are provided on said facing substrate.

45. An image forming apparatus comprising:

an electron-source substrate having electron emitting devices; and a facing substrate disposed so as to face said electron-source substrate, wherein an anode-potential regulating region which a potential to accelerate electrons emitted from said electron emitting devices is applied on, phosphors for emitting light by electrons emitted from the electron emitting devices, a conductive member, disposed around said anode-potential regulating region with a predetermined interval therewith, which a predetermined potential is applied on, a resistive film contacting said anode-potential regulating region and said conductive member, and a recess, positioned between said anode-potential regulating region and said conductive member, which is concave with respect to said electron-source substrate is provided on said facing substrate.

46. An image forming apparatus comprising:

an electron-source substrate having electron emitting devices; and a facing substrate disposed so as to face said electron-source substrate, wherein an anode-potential regulating region which a potential to accelerate electrons emitted from said electron emitting devices is applied on, phosphors for emitting light by electrons emitted from the electron emitting devices, a conductive member, disposed around said anode-potential regulating region with a predetermined interval therewith, which a predetermined potential is applied on, a resistive film contacting said anode-potential regulating region and said conductive member, and protrusions and recesses positioned between said anode-potential regulating region and said conductive member are provided on said facing substrate.

47. An image forming apparatus comprising:

an electron-source substrate having electron emitting devices; and a facing substrate disposed so as to face said electron-source substrate, wherein an anode-potential regulating region which a potential to accelerate electrons emitted from said electron emitting devices is applied on, phosphors for emitting light by electrons emitted from the electron emitting devices, and a conductive member, disposed around said anode-potential regulating region with a predetermined interval therewith, which a predetermined potential is applied on are provided on a same surface of said facing substrate facing said electron-source substrate, and wherein a multiple-scattering suppression structure for suppressing multiple scattering of secondary electrons generated by electrons emitted from said conductive member is disposed between said anode-potential regulating region and said conductive member on the same surface.

* * * * *

UNITED STATES PATENT AND TRADEMARK OFFICE

CERTIFICATE OF CORRECTION

PATENT NO. : 6,486,610 B2
DATED : November 26, 2002
INVENTOR(S) : Shinsuke Kojima et al.

It is certified that error appears in the above-identified patent and that said Letters Patent is hereby corrected as shown below:

Column 15,
Line 9, “an” should read -- and --.

Column 17,
Line 24, “of” should read -- of the --;
Line 28, “First,” should read -- 1) First, --.

Column 26,
Line 30, “members” should read -- member --.

Column 27,
Line 64, “which” should read -- to which --.

Signed and Sealed this

Eleventh Day of November, 2003

JAMES E. ROGAN
*Director of the United States Patent and Trademark Office*